US009652942B1

(12) United States Patent
Pertgen et al.

(10) Patent No.: US 9,652,942 B1
(45) **Date of Patent: *May 16, 2017**

(54) METHOD AND DEVICE FOR CONDUCTING A WAGERING GAME

(71) Applicant: AGS, LLC, Las Vegas, NV (US)

(72) Inventors: Michael J. Pertgen, Las Vegas, NV (US); William C. Judge, Las Vegas, NV (US)

(73) Assignee: AGS, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/953,696

(22) Filed: Nov. 30, 2015

Related U.S. Application Data

(63) Continuation of application No. 14/182,214, filed on Feb. 17, 2014, now Pat. No. 9,202,343, which is a continuation-in-part of application No. 13/654,921, filed on Oct. 18, 2012, now Pat. No. 8,651,932.

(60) Provisional application No. 61/690,883, filed on Jul. 7, 2012.

(51) Int. Cl.
*G07F 17/32* (2006.01)

(52) U.S. Cl.
CPC ..... *G07F 17/3293* (2013.01); *G07F 17/3244* (2013.01)

(58) Field of Classification Search
CPC ..... G07F 17/32
See application file for complete search history.

(56) References Cited

U.S. PATENT DOCUMENTS

| | | | |
|---|---|---|---|
| 4,836,553 | A | 6/1989 | Suttle et al. |
| 5,125,660 | A | 6/1992 | Stahl |
| 5,255,915 | A | 10/1993 | Miller |
| 5,275,415 | A | 1/1994 | Wisted |
| 5,288,081 | A | 2/1994 | Breeding |
| 5,294,128 | A | 3/1994 | Marquez |
| 5,382,025 | A | 1/1995 | Sklansky et al. |
| 5,411,268 | A | 5/1995 | Nelson et al. |
| 5,417,430 | A | 5/1995 | Breeding |
| 5,437,462 | A | 8/1995 | Breeding |
| 5,486,055 | A | 1/1996 | Oka |
| 5,584,485 | A | 12/1996 | Jones et al. |

(Continued)

OTHER PUBLICATIONS

State of Washington Gambling Commission, "Texas Hold 'Em Bonus Training Manual," http://www.wsgc.wa.gov/activities/game-rules/texas-hold-em-bonus.pdf, Oct. 28, 2014, 15 pages.

*Primary Examiner* — Omkar Deodhar
(74) *Attorney, Agent, or Firm* — Weide & Miller, Ltd.

(57) ABSTRACT

A method and device for conducting a game includes receipt of an ante wager designating either a first game hand or a second game hand for resolution of the ante wager. A first game hand of unexposed playing cards is dealt, and optionally exposed in stages with each stage interceded by an election received from players to either place an additional wager on the same game hand designed by the ante wager or check by proceeding to a subsequent stage without placing an additional wager. After the first game hand is exposed, an election is received to either place an additional wager on the same game hand designated by the ante wager or fold. A second game hand is dealt, exposed, and compared to the first game hand to resolve ante wagers on the respective hands. Optional and/or mandatory bonus wagers may be received on the game hands.

9 Claims, 18 Drawing Sheets

(56) References Cited

U.S. PATENT DOCUMENTS

| | | | |
|---|---|---|---|
| 5,626,341 | A | 5/1997 | Jones et al. |
| 5,664,781 | A | 9/1997 | Feola |
| 5,685,774 | A | 11/1997 | Webb |
| 5,713,574 | A | 2/1998 | Hughes |
| 5,735,524 | A | 4/1998 | Wisted |
| 5,762,340 | A | 6/1998 | Feola |
| 5,788,574 | A | 8/1998 | Ornstein et al. |
| 5,795,225 | A | 8/1998 | Jones et al. |
| 5,810,354 | A | 9/1998 | Banyai |
| 5,810,361 | A | 9/1998 | Kadlic |
| 5,823,879 | A | 10/1998 | Goldberg et al. |
| 5,839,731 | A | 11/1998 | Feola |
| 5,839,732 | A | 11/1998 | Guidi |
| 5,845,907 | A | 12/1998 | Wells |
| 5,851,011 | A | 12/1998 | Lott |
| 5,863,042 | A | 1/1999 | Lo |
| 5,913,726 | A | 6/1999 | Jones et al. |
| 5,951,012 | A | 9/1999 | Feola |
| 5,984,310 | A | 11/1999 | English |
| 5,995,022 | A | 11/1999 | Plis et al. |
| 6,012,374 | A | 1/2000 | Brandl et al. |
| 6,012,720 | A | 1/2000 | Webb |
| 6,019,374 | A | 2/2000 | Breeding |
| 6,056,641 | A | 5/2000 | Webb |
| 6,102,402 | A | 8/2000 | Scott et al. |
| 6,131,907 | A | 10/2000 | Nucifora et al. |
| 6,206,373 | B1 | 3/2001 | Garrod |
| 6,227,969 | B1 | 5/2001 | Yoseloff |
| 6,237,916 | B1 | 5/2001 | Webb |
| 6,264,560 | B1 | 7/2001 | Goldberg et al. |
| 6,273,424 | B1 | 8/2001 | Breeding |
| 6,299,170 | B1 | 10/2001 | Yoseloff |
| 6,332,614 | B1 | 12/2001 | Hesse |
| 6,336,859 | B2 | 1/2002 | Jones et al. |
| 6,371,851 | B1 | 4/2002 | Singer et al. |
| 6,386,973 | B1 | 5/2002 | Yoseloff |
| 6,428,005 | B2 | 8/2002 | Au-Yeung |
| 6,446,971 | B1 | 9/2002 | Baranauskas |
| 6,454,266 | B1 | 9/2002 | Breeding et al. |
| 6,457,714 | B1 | 10/2002 | Feola |
| 6,481,717 | B1 | 11/2002 | Richardelle |
| 6,517,072 | B1 | 2/2003 | McInerney |
| 6,547,246 | B2 | 4/2003 | Webb |
| 6,550,771 | B1 | 4/2003 | Weaver et al. |
| 6,575,465 | B2 | 6/2003 | Lo |
| 6,575,467 | B1 | 6/2003 | Kal |
| 6,609,711 | B1 | 8/2003 | Campbell |
| 6,637,746 | B1 | 10/2003 | Baranauskas |
| 6,637,747 | B1 | 10/2003 | Garrod |
| 6,679,777 | B2 | 1/2004 | Pfeiffer et al. |
| 6,698,759 | B2 | 3/2004 | Webb et al. |
| 6,719,292 | B2 | 4/2004 | Lo |
| 6,749,200 | B2 | 6/2004 | Yurkins |
| 6,808,173 | B2 | 10/2004 | Snow |
| 6,808,174 | B1 | 10/2004 | Rubin |
| 6,830,247 | B2 | 12/2004 | Lo |
| 6,938,900 | B2 | 9/2005 | Snow |
| 7,036,822 | B2 | 5/2006 | O'Grady |
| 7,055,822 | B2 | 6/2006 | Lo |
| 7,070,505 | B2 | 7/2006 | Vancura et al. |
| 7,118,112 | B2 | 10/2006 | Kenny et al. |
| 7,137,630 | B2 | 11/2006 | Yurkins |
| 7,201,375 | B2 | 4/2007 | Adam et al. |
| 7,201,654 | B1 | 4/2007 | Jarvis et al. |
| 7,222,854 | B2 | 5/2007 | Sorge |
| 7,246,799 | B2 | 7/2007 | Snow |
| 7,255,351 | B2 | 8/2007 | Yoseloff et al. |
| 7,264,243 | B2 | 9/2007 | Yoseloff et al. |
| 7,322,578 | B2 | 1/2008 | Swartz et al. |
| 7,367,563 | B2 | 5/2008 | Yoseloff et al. |
| 7,387,300 | B2 | 6/2008 | Snow |
| 7,413,509 | B2 | 8/2008 | Sklansky et al. |
| 7,438,293 | B2 | 10/2008 | Sklansky et al. |
| 7,458,582 | B2 | 12/2008 | Snow et al. |
| 7,464,935 | B2 | 12/2008 | Matusek et al. |
| 7,562,876 | B2 | 7/2009 | Sklansky et al. |
| 7,585,217 | B2 | 9/2009 | Lutnick et al. |
| 7,628,689 | B2 | 12/2009 | Snow |
| 7,661,676 | B2 | 2/2010 | Smith et al. |
| 7,694,970 | B2 | 4/2010 | Petty |
| 7,694,972 | B2 | 4/2010 | Wertzberger |
| RE41,331 | E | 5/2010 | Pfeiffer et al. |
| 7,735,830 | B2 | 6/2010 | Shackleford |
| 7,735,831 | B2 | 6/2010 | Sklansky et al. |
| 7,833,101 | B2 | 11/2010 | Lutnick et al. |
| 7,980,933 | B2 | 7/2011 | Kennedy |
| 7,997,973 | B2 | 8/2011 | Lutnick et al. |
| 8,020,872 | B2 | 9/2011 | Forster |
| 8,066,285 | B2 | 11/2011 | Gottlieb |
| 8,070,582 | B2 | 12/2011 | Lutnick et al. |
| 8,142,283 | B2 | 3/2012 | Lutnick et al. |
| 8,216,042 | B2 | 7/2012 | Crawford, Jr. et al. |
| 8,216,056 | B2 | 7/2012 | Lutnick et al. |
| 8,251,802 | B2 | 8/2012 | Snow |
| 8,272,958 | B2 | 9/2012 | Smith et al. |
| 8,292,714 | B2 | 10/2012 | Kennedy |
| 8,298,075 | B2 | 10/2012 | Tishler |
| 8,323,102 | B2 | 12/2012 | Lutnick et al. |
| 8,360,434 | B2 | 1/2013 | Smith et al. |
| 8,393,954 | B2 | 3/2013 | Lutnick et al. |
| 8,398,083 | B2 | 3/2013 | Costa |
| 8,398,481 | B2 | 3/2013 | Lutnick et al. |
| 8,398,489 | B2 | 3/2013 | Lutnick et al. |
| RE44,323 | E | 6/2013 | Goldberg et al. |
| 8,474,822 | B2 | 7/2013 | Chen et al. |
| 8,480,090 | B1 | 7/2013 | Lemberg et al. |
| 8,480,471 | B2 | 7/2013 | Lutnick et al. |
| 8,500,533 | B2 | 8/2013 | Lutnick et al. |
| 8,511,687 | B2 | 8/2013 | Kennedy |
| 8,512,116 | B2 | 8/2013 | Haushalter |
| 8,517,385 | B2 | 8/2013 | Harris |
| 8,535,160 | B2 | 9/2013 | Lutnick et al. |
| 8,556,706 | B2 | 10/2013 | Barney et al. |
| 8,590,900 | B2 | 11/2013 | Yoseloff |
| 8,636,575 | B2 | 1/2014 | Lutnick et al. |
| 8,668,566 | B2 | 3/2014 | Lutnick et al. |
| 8,688,517 | B2 | 4/2014 | Lutnick et al. |
| 8,690,156 | B2 | 4/2014 | Dusome et al. |
| 8,758,109 | B2 | 6/2014 | Lutnick |
| 8,758,111 | B2 | 6/2014 | Lutnick |
| 8,764,538 | B2 | 7/2014 | Lutnick et al. |
| 8,764,541 | B2 | 7/2014 | Lutnick et al. |
| 8,771,058 | B2 | 7/2014 | Alderucci et al. |
| 8,834,255 | B2 | 9/2014 | Lutnick et al. |

| BET MAX | BET 1 | BONUS BET 5 | ANTE BET 5 | TOTAL BET 10 | CREDITS 70 |
|---|---|---|---|---|---|

METHOD AND DEVICE FOR CONDUCTING A WAGERING GAME

RELATED APPLICATION DATA

The present invention is a continuation of U.S. patent application Ser. No. 14/182,214 filed Feb. 17, 2014, which is a continuation-in-part of U.S. patent application Ser. No. 13/654,921 filed Oct. 18, 2012, now U.S. Pat. No. 8,651,932, which claims the priority of U.S. Provisional Application Ser. No. 61/690,883 filed Jul. 7, 2012.

FIELD OF THE INVENTION

The present invention relates to methods and devices for conducting wagering games. More specifically, the present invention is a method and device for wagering on games in which one of the game hands is exposed, optionally in stages, before players are required to elect whether to continue the game with that hand or fold.

BACKGROUND OF THE INVENTION

A number of theories exist as to the origin of the game of poker. It is said by some authorities that Poker originates from the ancient Persian game of As-nas. The modem form of poker with its innumerable, different forms can be traced to the European game of Primero which was played with four cards per person and the cards were ranked in a complicated points system. In England, Primero was overtaken in popularity by a game called Brag of which there were many forms: three card, five card, seven card and nine card versions, the most popular being the three card stud version. Wild cards were often used in Brag and were known as Braggers.

In modem casinos the game of poker takes one of three forms: live or cardroom poker where players compete against one another and the House charges a levy either in the form of a participation fee or as a percentage of winning hands; electronic video machines offering various games of poker, in particular, five card draw poker; and poker played as a "banker's game" either where the game involves players in contest with the dealer's hand or where the object is for players to obtain a hand based on hierarchical poker rankings, or games which combine the above two objects.

Live or cardroom poker games currently available comprise Texas Hold'Em, Omaha and Seven-card stud. These games require considerable skill and a relatively large bankroll in order to become a competent player. As a result of these factors most novice players avoid cardroom games. Casinos have attempted to remedy this situation by providing poker-style table games that are house-banked and that require little expertise. Typical examples of such games are Caribbean Stud, U.S. Pat. No. 4,836,553 (to Suttle et al.), and Let It Ride, U.S. Pat. No. 5,417,430 (to Breeding et al.). Both games are based on five-card stud. In the former game the players hands are pitted against the dealer's hand and in the latter case the sole objective is to form a "payable" hand based on a set of odds related to hierarchical poker rankings.

A further example of a poker game that has been introduced into casinos in order to attract novice players is U.S. Pat. No. 6,237,916 (to Webb), the disclosure of which is incorporated by reference. The game of this patent is played as follows: it is a stud game and each player and the dealer is dealt three cards. Players bet against the dealer's hand or bet on the ranking value of their three-card hands (a "pairs plus" wager) or bet both wagers. To play against the dealer the player places an ante wager. After examining his hand the player may fold and lose his ante wager or continue play by placing a mandatory second, or play, wager equal to the ante. To win both wagers (1) the dealer must have a qualifying hand of a Queen high or better and (2) the player's hand must outrank the dealer's hand. If the dealer hand does not have a qualifying holding, the player wins an even money award on the ante wager and the second wager is a push/stand-off. If the player has made the "pairs plus" wager and his hand includes one of a schedule of winning holdings (pair or better), he receives a pay based upon the wager and the scheduled payoff.

The Webb three-card game is structured along the same lines as the five-card game Caribbean Stud. Both games are stud poker games and in both games the player's hand is pitted against the dealer's hand. Player appeal is essential to the long-term success of a game. Folding is an option that can be exercised in Caribbean Stud and the above three-card game. Statistics show that a Caribbean stud player will fold 46.97% of the time and the three-card player will fold 32.58% of the time, almost one in three hands. Although folding is an option that gives the player a chance to cut his loss, it is seen by many players as taking the fun away from the game. When a player folds not only does he lose his bet but he loses interest in the game being played out. A further shortcoming of the structure of the above two games, from a player's perspective, is the rule that the dealer must have a qualifying hand, irrespective of the dealer losing against the player's higher hand, for the player to win and be paid out. This factor is a source of major irritation to a player with a good hand who does not get paid on the second wager simply because the dealer does not qualify. Further, where there are up to seven players at a table, where the dealer does not qualify, he does not qualify as to all players

SUMMARY OF THE INVENTION

A method for conducting a wagering game may be conducted at a live table or on an electronic device. A game may be conducted for at least one player using a set of game pieces to form a player hand and a banker hand.

A bonus pay table of bonus game hands and associated pay outs is defined. In an embodiment in which the game is conducted on an electronic device, the bonus pay table may be stored in a data storage device.

A first wager designating only one of the player hand or the banker hand for resolution of the first wager is received. In an optional embodiment in which a game is conducted on an electronic device, a first wager may be received through a player interface. A bonus wager is also received.

A player hand and a banker hand are dealt. The player hand and banker hand are exposed in stages, with a mandatory bet on either the player or banker hand at each stage. For example, in an optional embodiment, the player hand and banker hand each include two cards. The first wager is received on either the banker hand or player hand before any cards are exposed (or, in an alternate optional embodiment, before any cards are dealt). A second wager is received after one card of each of the player hand and banker hand are exposed. The second wager may be placed on the same hand designated by the first wager, or on a different hand. A third wager is received after the second card of either the banker hand or the player hand is exposed, thereby fully exposing either the banker hand or player hand. The third wager may designate either the banker hand or the player hand. Again, in an optional embodiment conducted using an electronic device, elections to place an additional wager or check may be received through a player interface.

The remaining unexposed card is exposed. The player hand and banker hand are compared. In an optional embodiment, the player hand and banker hand are compared by calculating the sum, modulo ten, of the values of the cards in the hands and comparing the relative ranking of the sum, modulo ten, to a target value. For example, in one optional embodiment, the target value is nine such that wagers on the hand with the value closer to nine are paid and wagers on the hand with the value further from nine are collected. Optionally, all wagers on the player hand and banker hand are collected in the event of a tie.

In an optional embodiment, side wagers may be offered. Side wagers may be mandatory or optional. In one optional embodiment, a mandatory side wager and an optional side wager may be received. In one such optional embodiment, a mandatory side wager may be rewarded when any natural sum (e.g., eight or nine in a game in which the hands are scored by summing, modulo ten, the values of the cards in the hand) occurs in either hand or a tie occurs. In an additional or alternate optional embodiment, an optional side wager may be rewarded when any matching cards appear within the two hands. In one such optional embodiment, a pay table may be defined in which the payout is based on the quantity of matching cards.

In another optional embodiment, an ante wager may be received. A first poker hand may be dealt fully exposed. A second poker hand may be dealt unexposed. A display may calculate the relative strength of the exposed first poker hand. In an optional embodiment, a data processor may calculate the odds associated with the likelihood that the first poker hand will win against any other poker hand that could be formed from the remaining cards in the deck. Based on the relative strength of the exposed first poker hand, a data processor may calculate a payout that may be paid against a bet received at that stage of the game.

In an optional embodiment, only a single stage occurs where an election to bet or fold. Again, the payout if an election to bet is dynamically calculated and displayed based on the relative strength of the first poker hand. In such an optional embodiment, when an election to bet is received, an additional wager is also received. When an election to fold is received, no additional wager is received and the ante wager is collected.

In an alternate optional embodiment, an election to bet or check may occur at a single stage, such that the additional wager above and beyond the ante wager is optional.

In yet another optional embodiment, multiple stages may be conducted with cards of the unexposed second poker hand exposed and elections to bet or fold (or bet or check) received at each stage. In one such optional embodiment, bet placed during additional stages in which cards of the second poker hand are exposed may be associated with different payouts, since the display in such optional embodiments could be dynamically updated to reflect the relative strength of the first poker hand compared to the partially exposed second poker hand.

After betting stages have been completed, the second poker hand is exposed and compared to the first poker hand. If the second poker hand outranks the first poker hand, the ante wager and additional wager are rewarded with the payout dynamically determined and displayed when the additional wager was placed. If the first poker hand outranks the second poker hand, the ante wager and additional wager are collected.

In an optional embodiment, a side wager may be offered in which a side wager pay table is defined which correlates bonus poker hands with payouts. After both the first poker hand and second poker hand are exposed, a determination is made whether either the first poker hand or second poker hand contain a bonus poker hand according to the side wager pay table. In one optional embodiment, side wagers are rewarded based on the highest payout associated with a bonus poker hand appearing in either the first poker hand or the second poker hand.

In an optional embodiment, a method may be conducted at a gaming device. In one such optional embodiment, a gaming device may include a data processor in communication with a display, a player interface, and a data storage device. The data storage device may be configured to store program instructions to execute a method such as that described above.

DETAILED DESCRIPTION OF THE INVENTION

Reference is now made to the figures wherein like parts are referred to by like numerals throughout. The present invention includes methods and devices for conducting wagering games. The present invention could be applied to any type of game, regardless of the platform, game equipment, and game rules of the underlying game. The present invention is described generally and specific examples of the present invention as applied to various underlying games are given.

In general, the present invention is directed to a wagering game method and device in which a plurality of game hands is dealt. In the present invention, a first game hand is completely exposed before a player is required to determine whether to complete the game to resolution. The present invention also allows a player to increase the amount wagered on a game hand (whether the first game hand or another game hand) as the first game hand is exposed.

The present invention includes game hands, which may be, but are not necessarily, community hands insofar as they are shared among all players. That is, in such an optional embodiment, a player select to wager on a shared game hand rather than being dealt an individual game hand. However, this description and the examples below should be interpreted as illustrative rather than limiting, since it is contemplated that the present invention could be applied to games in which individual game hands are dealt to individual players.

Game hands are formed from game pieces. In an optional embodiment, game pieces may take the form of playing cards, tiles, roulette numbers, keno numbers, bingo numbers, dominoes, dice faces, or the like. Some examples of games which can be combined with the present invention are given below.

Figure 1:
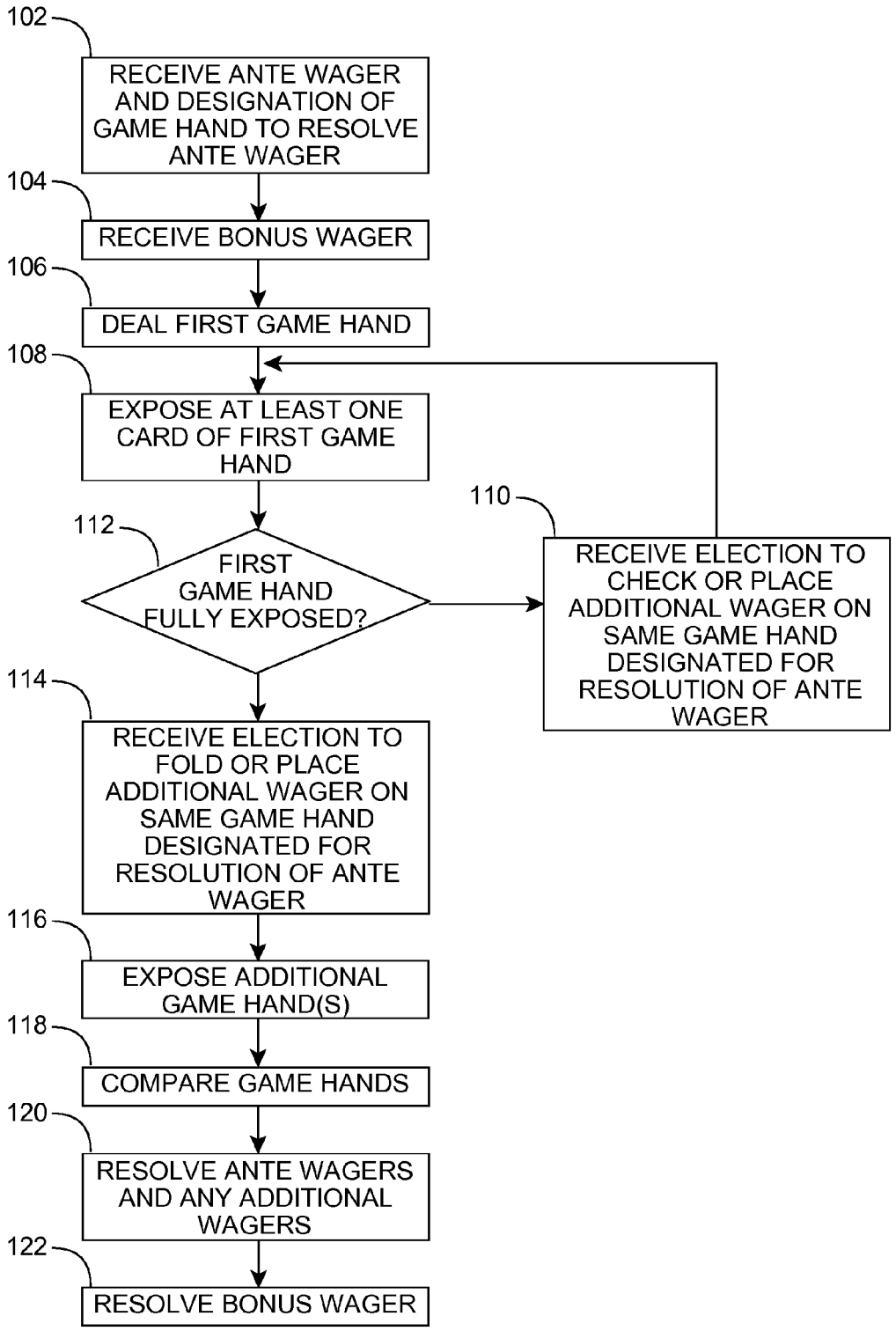
FIG. 1 is a flow chart of a method according to an embodiment of the present invention.
Figure 3:
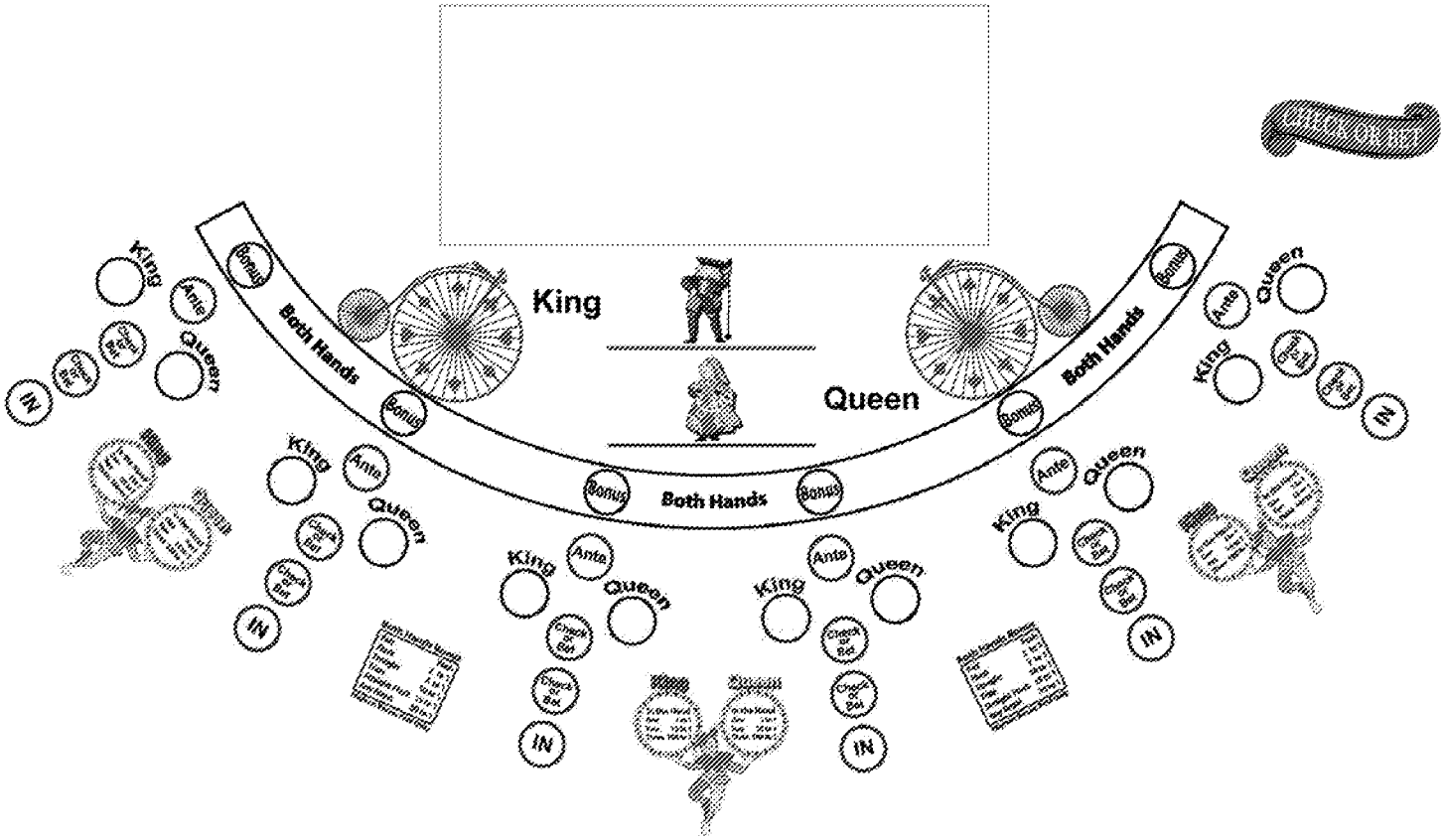
FIG. 3 is a top view of a table layout for conducting a method according to an embodiment of the present invention.

Referring to FIG. 1, a method may begin with placement of an ante wager designating one of a plurality of game hands. That is, in the course of the game, a plurality (i.e., at least two) game hands are dealt and exposed. An election is received from each player of one game hand to use for resolution of the player's wagers. For ease of identifying which game hand the player has elected for resolution of the player's wager, the game hands could be identified in some way, such as by numbering the game hands, naming the game hands, e.g., "King hand" and a "Queen hand" as in FIG. 3, or otherwise marking or distinguishing the game hands so the player's wager can be associated to the game hand elected for resolution of the player's wagers. For example, in the optional embodiment illustrated in FIG. 3, a game includes two game hands, a King hand and a Queen hand. Players electing to wager on the Queen hand could place a wager in a Queen wagering area 302 while players electing to wager on the King hand could place a wager in a King wagering area 304. As may be appreciated, the designation used to identify the hands may vary from embodiment to embodiment.

Figure 2:
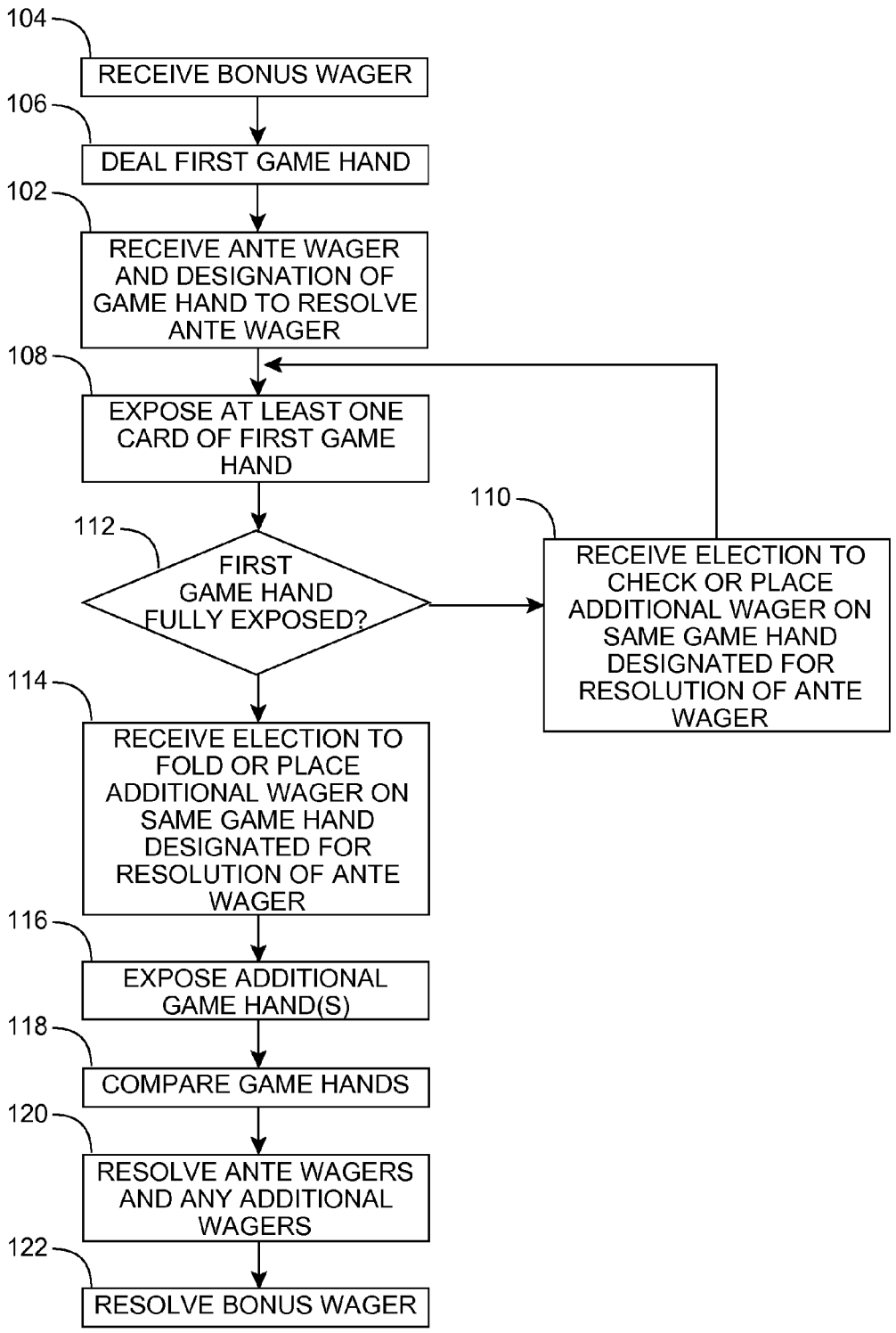
FIG. 2 is a flow chart of a method according to an embodiment of the present invention.

Referring to FIG. 2, at least one, but fewer than all, the game pieces of the first game hand and/or the second game hand may be exposed before receiving ante wagers. That is, in an optional embodiment, partial information about the game pieces making up the game hands may be revealed to the players prior to the players electing which game hand to designate for resolution of the players' wagers.

In an optional embodiment, a bonus wager may be required in addition to the ante wager. In one such optional embodiment, the bonus wager may be constrained by predetermined betting limits, e.g., the bonus wager may be required to be a certain multiple, or within a defined range of multiples, of the ante wager. For example, in an optional embodiment, the bonus wager must be equal to the ante wager. In other optional embodiments, other limits may apply to the bonus wager.

Depending on the optional embodiment, the bonus wager may also require designation of how the bonus wager is to be resolved. For example, in an optional embodiment, the bonus wager is resolved using the same game hand designated by the ante wager. Thus, if an ante wager designated the Queen hand for resolution of the ante wager, the bonus wager in an optional embodiment may also be resolved using the Queen hand. In an alternate optional embodiment, the bonus wager may not be restricted to any game hand. For example, in an optional embodiment, the bonus wager may be resolved using the higher (or highest) ranking game hand. Thus, in such an optional embodiment, every bonus wager is resolved based on the same game hand, although the specific game hand would not be known until all the game hands are revealed and the higher (or highest) ranking game hand is determined. In such an optional embodiment, the bonus wager may create a community feeling among players since all the bonus wagers would win or lose together. It is contemplated that additional mandatory or optional side wagers may also be provided. Other bonus wagers and optional side wagers are described in greater detail below.

A first game hand is dealt. The game hands may include any quantity of game pieces. While the example shown in FIG. 3 includes four playing cards dealt to each game hand, this example should be understood as illustrative rather than limiting. Additionally, the game hands may not include a fixed quantity of game pieces. For example, in a method applied to blackjack or baccarat, additional game pieces may be added to a game hand based on the sum of the values of the game pieces already in the hand, i.e., the game hand may hit and receive an additional game piece.

As may be appreciated, the deck or inventory may have any constitution, including one or more conventional decks of playing cards, one or more conventional set of pai gow tiles, one or more truncated decks (such as Spanish decks) of playing cards, one or more supplemented decks (such as conventional decks including Jokers or other additional cards) of playing cards, or any other deck or set constitution. In one optional embodiment, all game pieces of a game hand are randomly selected from a deck or inventory of game pieces. In another optional embodiment one or more game hands may include a predetermined game piece. For example, a first game hand formed using playing cards may always include one Queen and a second game hand formed using playing cards may always include one King.

The first game hand is exposed in stages. As discussed above, a portion of the first game hand may be exposed prior to receiving ante wagers and/or bonus wagers. In such an optional embodiment, players would have some information about the first game hand before placing wagers.

A stage may include the exposure of any quantity of game pieces. Specifically, a stage includes exposure of at least one game piece. It is contemplated that stages may include exposure of different quantities of game pieces. For example, in an embodiment in which a first game hand includes four game pieces, the four game pieces may be exposed in four stages, with one game piece exposed in each stage; three stages, with two game pieces exposed in one stage and one game piece exposed in two other stages; two stages, with three game pieces exposed in one stage and one game pieces exposed in another stage or two game pieces exposed in each of two stages. Put another way, a four card hand could be exposed in any of the patterns illustrated in Table 1. As may be appreciated, similar tables may be constructed for game hands including other quantities of game pieces.

TABLE 1

| Number of Stages | Pattern of Exposure (Game Pieces Exposed per Stage) |
|---|---|
| 4 | 1-1-1-1 |
| 3 | 2-1-1 |
| | 1-2-1 |
| | 1-1-2 |
| 2 | 3-1 |
| | 2-2 |
| | 1-3 |

Each stage is interceded by a wagering round in which an election is received to either place an additional wager on the same hand designated by the ante wager or check by placing no additional wager. In an optional embodiment, a player may not place an additional wager on any other game hand—any additional wager must be placed on the same game hand designated by the ante wager. Thus, in the example illustrated in FIG. 3, a player who places an ante wager on the Queen hand must either place an additional wager on the Queen hand or check; the player of such a game may not place a wager on the King hand during a wagering round between stages of exposing the first game hand.

It is noted that elections to bet or check are also received from players with ante wagers designating game hands that are not being exposed. That is, as the first game hand is exposed, players with wagers on "other" game hands beside the first game hand may elect to either place an additional wager on the "other" game hand designated for resolution of the player's ante wager or check. Thus, as the first game hand is exposed in stages, players with ante wagers on the first game hand will make elections to bet or check knowing the quality of the game hand on which they are betting, whereas players with ante wagers on other game hands will make elections to bet or check knowing the quality of the opponent game hand, i.e. the game hand against which they are playing. This will be described in greater detail below.

As noted above, in an optional embodiment, a portion, but not all, of one or more additional game hands may be revealed as the first game hand is exposed. In one such optional embodiment, a single game piece of the first game hand and a single game piece of any additional game hand(s) are exposed. A round of wagering may occur before exposing a second game piece of the first game hand. Alternatively, a second game piece of the first game hand may be exposed with the first game piece of the first game hand so that two game pieces are exposed together prior to a first wagering round. The remaining game pieces may be revealed in stages interceded by wagering rounds.

After the first game hand is exposed, an election is received from each player to wager on the same game hand designated for resolution of the player's ante wager or fold. If the player elects to fold, the player's ante wager and any additional wagers are collected. If the player elects to wager, the final wager may be constrained by predetermined wager limits (minimum, maximum, or both). In one optional embodiment, the wager placed after the first game hand is revealed may be required to match the player's ante wager.

As above, the election to wager after the first game hand is exposed is provided to all players regardless of which game hand was designated for resolution of the ante wager. Put another way, every player with an ante wager must either bet on the game hand associated with that ante wager or fold. Thus, for players wagering on the first game hand, the player elects to bet or fold based on whether the player expects the fully exposed first player hand to have a ranking that will outrank the other game hands. Conversely, for players wagering on other game hands, the player elects to bet or fold based on whether the unexposed game hand on which the player wagered can outrank the fully exposed opponent hand, i.e., the first player hand. Again, more specific examples are given below.

After receiving elections from players to bet or fold, the additional game hand(s) are exposed. In an optional embodiment, the additional game hand(s) are exposed without any additional betting rounds. That is, in an optional embodiment, all wagering occurred as the first game hand was exposed and, thus, no additional wagering on the game hands occurs after the first game hand is exposed, i.e., while the additional game hand(s) are exposed. In an optional embodiment, the quantity of cards in the first game hand and any additional hand(s) may vary depending on the constitution of the hand and/or certain rules or decisions made in forming hands. For example, in an optional embodiment based on conventional baccarat, the quantity of game pieces (e.g., playing cards) in a game hand may depend on the sum of the initial two game pieces, with certain sums causing the dealing of an additional card to form a three-card hand and other sums associated with standing on the initial two cards.

Ante wagers and additional wagers are resolved by comparing game hands. The method of comparison could take any form, including summing the values of game pieces and comparing the sum associated with each game hand (such as in blackjack, baccarat, or the like), defining a ranking of game piece combinations and comparing the relative rankings of each game hand (such as in poker, reel slots, pai gow poker, pai gow, or the like), or any other comparison system. It is contemplated that in comparing game hands, one or more additional steps may be taken to prepare the game hands for comparison. For example, in certain games, such as draw poker or the like, game pieces may be discarded from a game hand and replaced with other game pieces. In other games, game hands may be combined with community cards. In yet other games, such as pai gow and pai gow poker, game hands may be separated into sub-hands or component hands. In an optional embodiment in which the game hands are shared, a house dealer or banker may control game hands.

It is also noted that a comparison system may differ from known systems insofar as the system may be developed specifically for the present game, such as four-card poker rankings. Examples of various methods of comparison are given in the examples below. As may be appreciated, the method and system described herein could be applied to any game, since the method and system described are directed to the method of receiving wager elections and revealing the game hands and are not limited to any particular game application or use. In an optional embodiment, game hands may always be compared to resolve wagers without requiring game hands to have a qualifying holding.

In an optional embodiment, ante wagers and any additional wagers are rewarded at even money when the game hand designated for resolution of the ante wager outranks the other game hand(s). For example, if the first game hand is designated for resolution of an ante wager, and a player elects to place two additional wagers and elects to bet rather than fold, all four wagers would be rewarded at even money if the first game hand is the highest (or higher) ranking game hand among all the game hands dealt and exposed. Conversely, if the first game hand is outranked by at least one other game hand, the four wagers may be collected. In an optional embodiment, wagers may be rewarded without assessing a commission.

In an optional embodiment, ties may be resolved in any manner. In one optional embodiment, ties may always result in a win or loss of the wagers, i.e., ties may be player-winning or house-winning outcomes. In an alternate optional embodiment, ties may result in a push of the wagers, with wagers returned to the players. In yet another optional embodiment, ties may be broken by comparing individual game pieces within the game hands, dealing or drawing an additional game piece, or the like. In yet another optional embodiment, ties may be resolved using a combination of the above, e.g., breaking some ties, treating some ties as automatically winning or losing outcomes, and/or resolving some ties as pushes.

In an optional embodiment, receipt of bonus wagers is required for eligibility in the game. That is, in an optional embodiment, the bonus wagers are mandatory and the game cannot be conducted solely with an ante wager and any additional wagers. The basis for resolving bonus wagers may take any form. In one optional embodiment, a bonus pay table is defined to associate pay outs with certain game pieces and/or game piece combinations. In one optional embodiment, game hands are compared to the bonus pay table to determine whether a bonus wager is paid. In such an optional embodiment, the pay outs could be based on any feature of the game hand. For example, the bonus pay outs could be issued based on the combination formed by the game pieces of the hand (such as straight flush), the game pieces in the game hand (such as the quantity of Kings or Queens in the game hand), the sum of the values of the game pieces in the game hand (such as a natural or Blackjack sum), or any other feature or attribute of the game hand and/or the game pieces in the game hand.

In one optional embodiment, the bonus wager may be resolved using only the game hand selected by a player for resolution of the player's ante wager. For example, if the player elects a first game hand for resolution of the player's ante wager and any additional wagers, the first game hand is also used to resolve the player's bonus wager.

In another optional embodiment, the bonus wager may be resolved using any game hand. For example, in an optional embodiment, bonus wagers may be resolved by the higher (or highest) ranking game hand regardless of which game hand was selected by the player for resolution of the player's ante wager. As may be appreciated, in such an optional embodiment, all players would be rewarded on, or lose, bonus wagers together. That is, if any game hand is entitled to a pay out based on the bonus pay table, all players receive a pay out based on their bonus wagers, independent of whether any player had or had not selected that particular game hand for resolution of the player's ante wager and optional additional wagers.

In yet another optional embodiment, the game pieces may be arranged into a matrix with defined pay lines, and the combination of game pieces may be evaluated along the pay lines, optionally without regard to which game hand the game piece was originally dealt. For example, two game hands may be positioned with one above the other, and pairs of vertically aligned game pieces (one from each game hand) may be compared to winning combinations on a bonus pay table. In an optional embodiment, additional game pieces, e.g. game pieces not dealt to the game hands, duplicates of game pieces dealt to the game hands, or the like, may be arranged in the matrix to fill in larger matrices and provide additional combinations along pay lines. In an optional embodiment, such a matrix game may be separate from the game hand method described above and may be separately conducted at the option of the player. For example, in one such embodiment, a matrix game (which may be displayed to resemble a reel slot game) may be optional and separately selected for play by receiving an additional wager from a player. In such an optional embodiment, the game could combine both a game hand, e.g., playing card or poker, component as well as a matrix, e.g., reel slot game, component.

As may be appreciated, additional side wagers (either mandatory or optional) could also be offered. For example, an optional side wager could be received on certain combinations that may occur in the game hands. In one such optional embodiment, the payout on a side wager may be a progressive jackpot that is funded from a rake of the side wagers. As may be appreciated, the combinations that result in an award for a side wager may vary depending on the game. For example, in a four-card poker game, a progressive jackpot may be paid when a first game hand including four Queens and a second game hand including four Kings occur simultaneously. It is contemplated that such an example may also include payouts for other game piece combinations or game hands.

Figure 4:
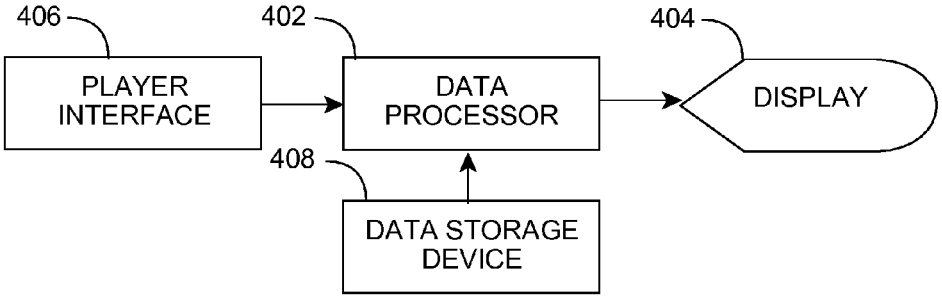
FIG. 4 is a block diagram of a device according to an embodiment of the present invention.

In an optional embodiment, the present invention may be conducting using a gaming device. A gaming device may simply operate on game pieces to randomly distribute game pieces to game hands. For example, a gaming device may take the form of a card shuffler, card shoe, wheel, ball blower, dice shaker, or the like to randomize game pieces and/or distribute randomly selected game hands. Additionally or alternatively, a gaming device may include a display to display the game hands. Where a gaming device includes a display, it may take any form, including a personal computer, tablet device, mobile telephone, video gaming machine, mechanical gaming machine, kiosk, PDA, or the like. In an optional embodiment illustrated in FIG. 4, the gaming device includes a data processor 402 in communication with a display 404, a data storage device 406, and a player interface 408. The data storage device 406 may take any form, including magnetic, optical, Flash, or other memory, and is configured to store graphics, sounds, parameters for conducting the game method, and the like. The data storage device 406 also stores program instructions executable by the data processor 402 to conduct a game according to an embodiment of the present invention.

In one such optional embodiment, the data processor 402 receives a bonus wager and an ante wager through the player interface 408. The player interface 408 may take any form, including a button panel, keyboard, keypad, mouse, pointer, or the like. In a further optional embodiment, the player interface 408 may be combined with the display 404 in a touchscreen device. In placing the ante wager, an election is also received through the player interface 408 designating a game hand for resolution of the ante wager and any additional wagers that may be placed subsequently. In the examples shown in FIGS. 5A-5F and 6A-6F, a first game hand is called a "Queen Hand" and a second game hand is called a "King Hand" and the election may, in such an example, constitute selecting either the Queen Hand or the King Hand.

The display 404 may take any form, including a plasma display, liquid crystal display ("LCD"), organic light emitting diode ("OLED") display, cathode ray tube ("CRT") monitor, mechanical reels, or the like. As may be appreciated, in a gaming device with an electronic display, the game may be accompanied by animation to provide entertainment during the course of the game.

The first game hand is exposed in stages. In an optional embodiment, a portion of the first game hand may be exposed prior to receiving the ante wager. In another optional embodiment, none of the first game hand is exposed prior to receiving the ante wager. In yet another optional embodiment, the first game hand always includes a designated game piece and this designated game piece may be exposed prior to, or after, the ante wager is received.

As discussed above, the quantity of stages and the quantity of game pieces exposed in each stage may vary depending on the optional embodiment. As applied to certain games, such as poker, pai gow, or the like, a first game hand may be revealed in multiple stages, with one or two cards exposed in each stage. In other games, such as baccarat, blackjack, or the like, the first game hand may be revealed initially in a single stage, with any "hit" cards revealed in later stages.

Between each stage, an election is received to bet or check, i.e., place an additional wager on the same hand previously designated for resolution of the ante wager or check and proceed to the next stage without placing any additional wager. In an optional embodiment, the election to bet or check is received through the player interface 408.

After the first game hand is fully revealed, an election is received through the player interface 408 to bet or fold, i.e., place an additional wager on the same hand selected for resolution of the ante wager or fold and terminate play. If an election to fold is received, the device retains the ante wager and additional wagers, if any. In an optional embodiment, the bonus wager remains in play and may result in an award depending on the conditions for winning the bonus wager.

Again, as above, at this point, the first game hand is fully exposed. If the first game hand was elected for resolution of the player's ante wager and any additional wagers, the election to bet or fold is likely based on the expectation that the fully exposed first game hand will outrank the as-yet unexposed (or partially exposed) additional game hand(s). If an additional game hand was elected for resolution of the player's ante wager and any additional wagers, the election to bet or fold is likely based on the expectation that the fully exposed first game hand will be outranked by the as-yet unexposed (or partially exposed) additional game hand.

Ante wagers and additional wagers are resolved by the data processor by issuing a payout for ante wager and additional wagers, if any, when the game hand designated for resolution of the ante wager and additional wagers, if any, outranks the other game hand(s). As discussed above, any comparison method may be used to evaluate the game hands. For example, in one optional embodiment, a hand ranking system may be defined and the relative rankings of the game hands may be compared. Such ranking systems could be based on known rankings, such as poker rankings, pai gow rankings, or the like, or novel rankings, such as four-card poker rankings or the like. In another optional embodiment, comparisons are made by summing the values of the game pieces in each game hand and comparing the sum or hand score associated with each game hand.

Bonus wagers are likewise resolved. In an optional embodiment, bonus wagers are resolved by comparing game hands, or game pieces within game hands, to a bonus pay table. In one optional embodiment, bonus wagers are rewarded based on the higher or highest ranking bonus hand, thus, in an optional embodiment, a bonus wager may be rewarded even when the ante wager and any additional wagers are lost.

As above, game hands may be compared to the bonus pay table as game hands, or the game pieces in the game hands may be arranged or rearranged into a matrix. Alternatively, a matrix game may be conducted separate from the game method including game hands and may require a separate wager in addition to any ante wagers, additional wagers, or bonus wagers. In one such an optional embodiment, an election may be received at the conclusion of the game hand game to wager on a matrix game. In one such optional embodiment, the game pieces dealt and exposed in the game hands are used to populate the matrix and, thus, an election to wager on a matrix game may be influenced or determined by the game pieces displayed in the game hands. In one such optional embodiment, the matrix may be displayed at the display 404. The game pieces are added to the matrix and the game pieces and/or game piece combinations are evaluated along defined pay lines.

Referring to the specific examples of FIGS. 5A-5F and 6A-6F, one optional embodiment may be directed to a four-card poker game. In one such optional embodiment, a first game hand may be referred to as a Queen hand and a second game hand may be referred to as a King hand.

An ante wager is received along with a designation of the hand (either the Queen hand or the King hand) that is to be used to resolve the ante wager and any additional wagers. A bonus wager is also received. To illustrate the present game, the example of FIGS. 5A-5F include a designation of the Queen hand while the example of FIGS. 6A-6F include a designation of the King hand. As may be appreciated, although these examples are directed to a single-player game, a multi-player game (either in an electronic or live-table form) could include designations from different players of the Queen hand and the King hand simultaneously.

Figure 5A:
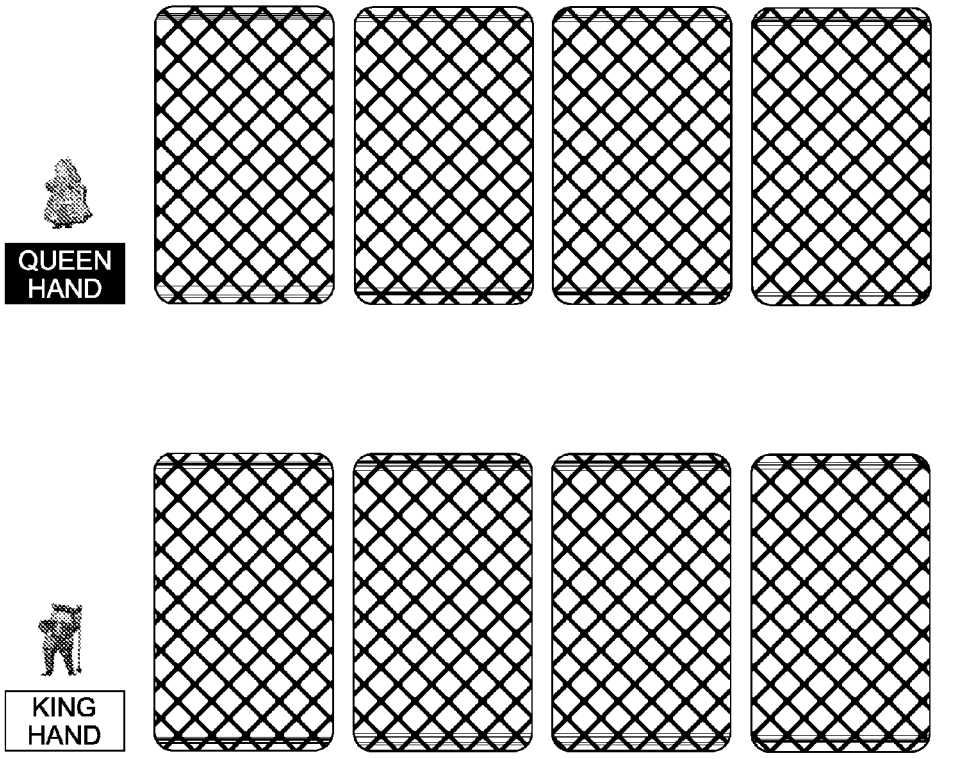
FIG. 5A is a front view of a screen shot of a game conducted according to an embodiment of the present invention.

Referring to FIG. 5A, an ante wager and a designation of the Queen hand are received. In the optional embodiment of FIG. 5A, the designation is received by activating a button on a touchscreen. In a table game version, such as that illustrated in FIG. 3, different wagering areas may be provided to identify wagers on the Queen hand or King hand.

Figure 5B:
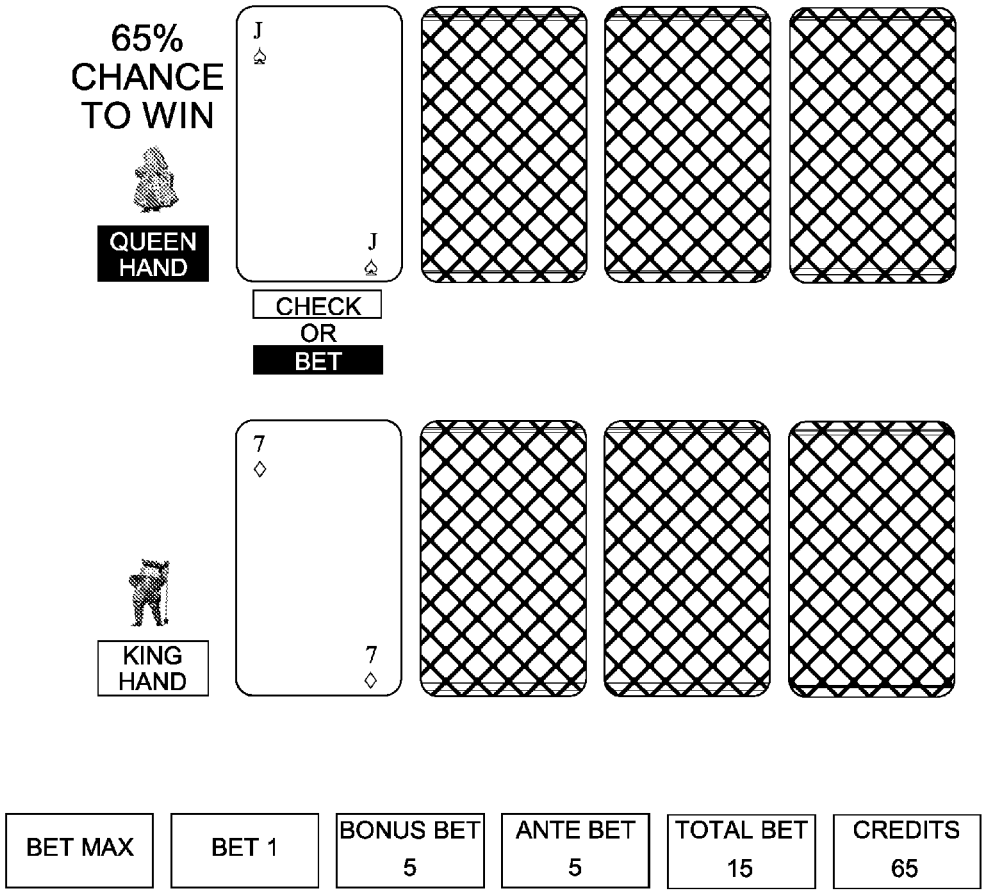
FIG. 5B is a front view of a screen shot of a game conducted according to an embodiment of the present invention.

Referring to FIG. 5B, the first cards of the Queen hand and King hand are exposed and an election is received whether to place an additional wager on the Queen hand. In this case, a player may expect the Queen hand to outrank the King hand and, thus, may elect to bet rather than check. As may be appreciated, if an election of the King hand, rather than the Queen hand, had been received a player may elect to check, as the player may expect the King hand to be outranked by the Queen hand. The strategy for players may vary and a player may also believe that an insufficient amount of information is available to bet and may, as a result, elect to check. In the optional embodiment of FIGS. 5A-5F, a display may be included to show which hand is favored, a percentage likelihood of winning, or the like. The example of FIGS. 5A-5F are merely examples and different calculations could lead to different percentage displays. It is further contemplated that in a live table game environment, display screens may likewise display the odds or percentages associated with the likelihood of a game hand winning.

Figure 5C:
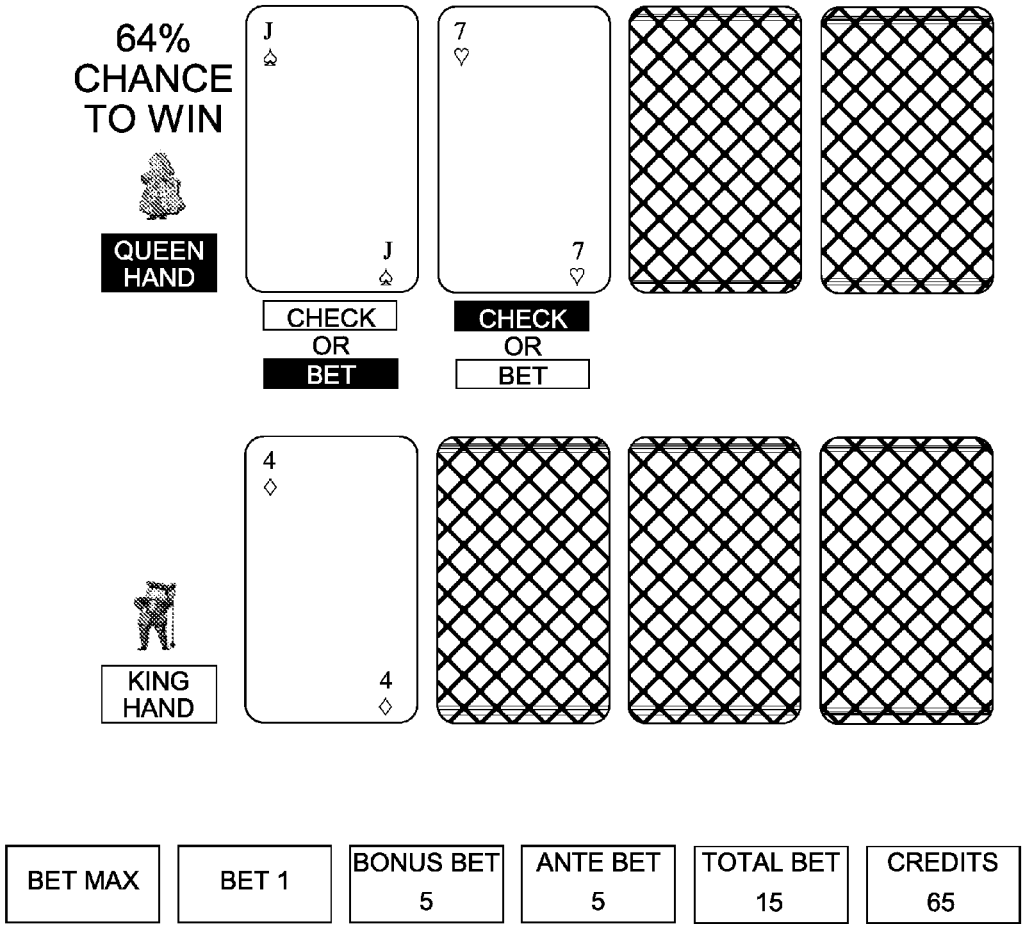
FIG. 5C is a front view of a screen shot of a game conducted according to an embodiment of the present invention.
Figure 5D:
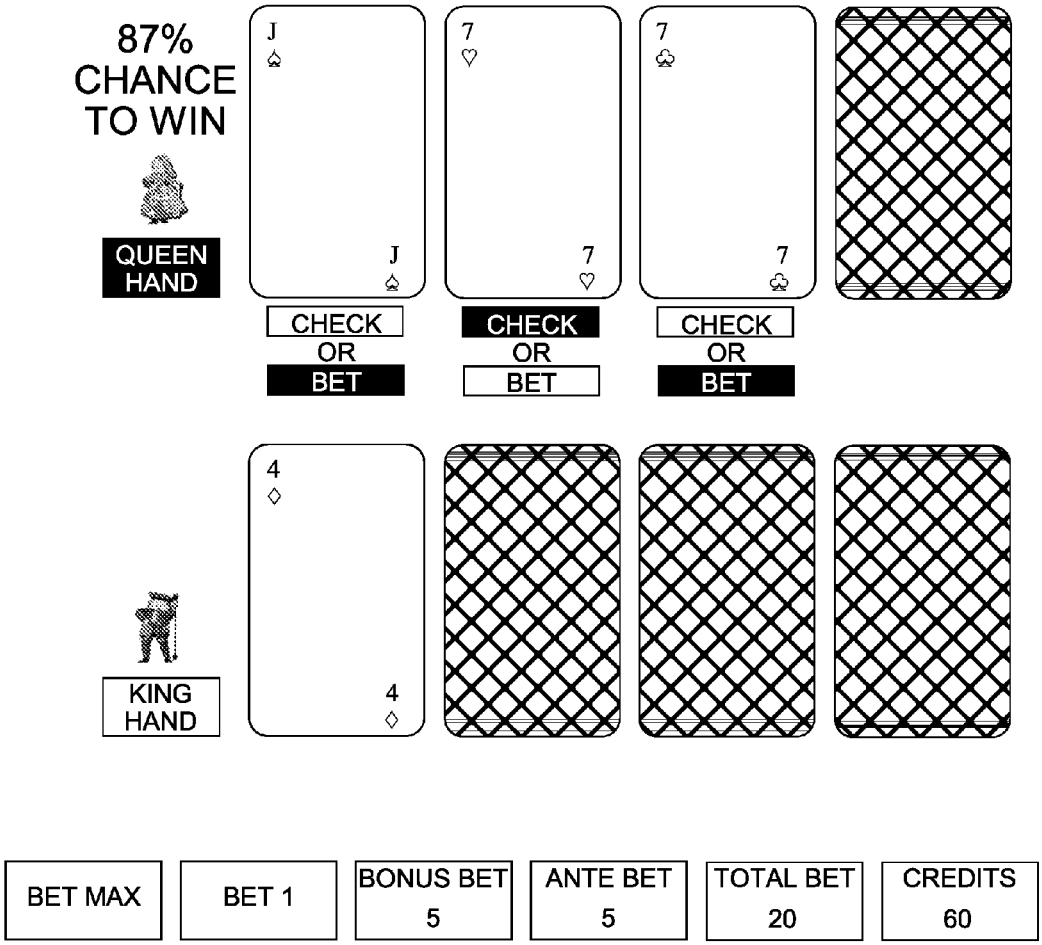
FIG. 5D is a front view of a screen shot of a game conducted according to an embodiment of the present invention.
Figure 5E:
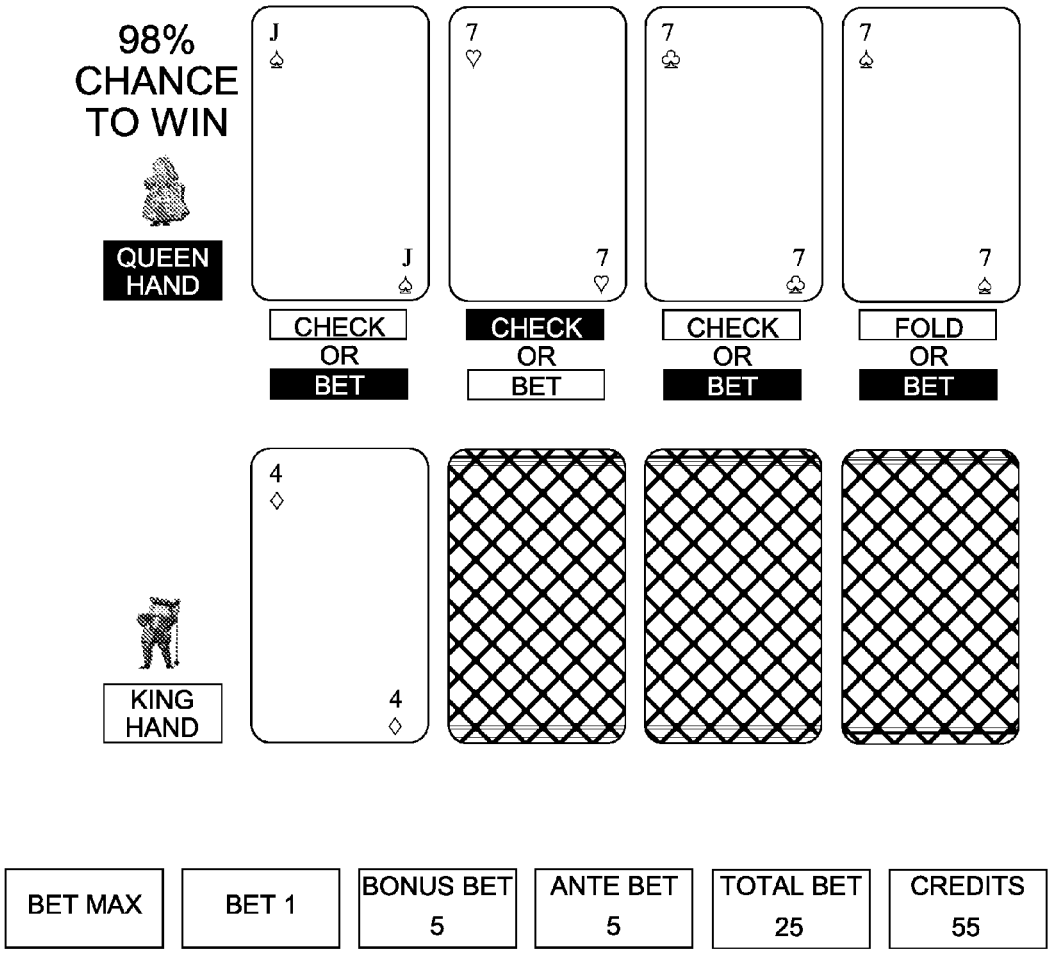
FIG. 5E is a front view of a screen shot of a game conducted according to an embodiment of the present invention.

FIGS. 5C-5E each shows a subsequent stage in which one playing card is exposed and an election to bet or check is received. In this example, the second card revealed is neither the same suit nor the same value as the first card, and is lower in value. Based on this, a player may elect in FIG. 5C to check rather than bet. That is, the player may elect to move to the next stage without placing any additional wager.

The third card, however, has the same value as the second card and, in this example which uses modified poker hand rankings, forms a pair. In the example of FIG. 5D, a player may elect to bet based on his or her expectation that the pair in the Queen hand will outrank whatever the King hand contains.

The fourth card has the same value as the second and third cards and forms a three of a kind. Again, in the example of FIG. 5E, a player may elect to bet rather than fold, based on his or her expectation that a three of a kind will outrank the as-yet unexposed King hand. As may be appreciated, the decision in FIG. 5E to bet on the Queen hand or fold is made after the entire Queen hand is exposed.

Figure 5F:
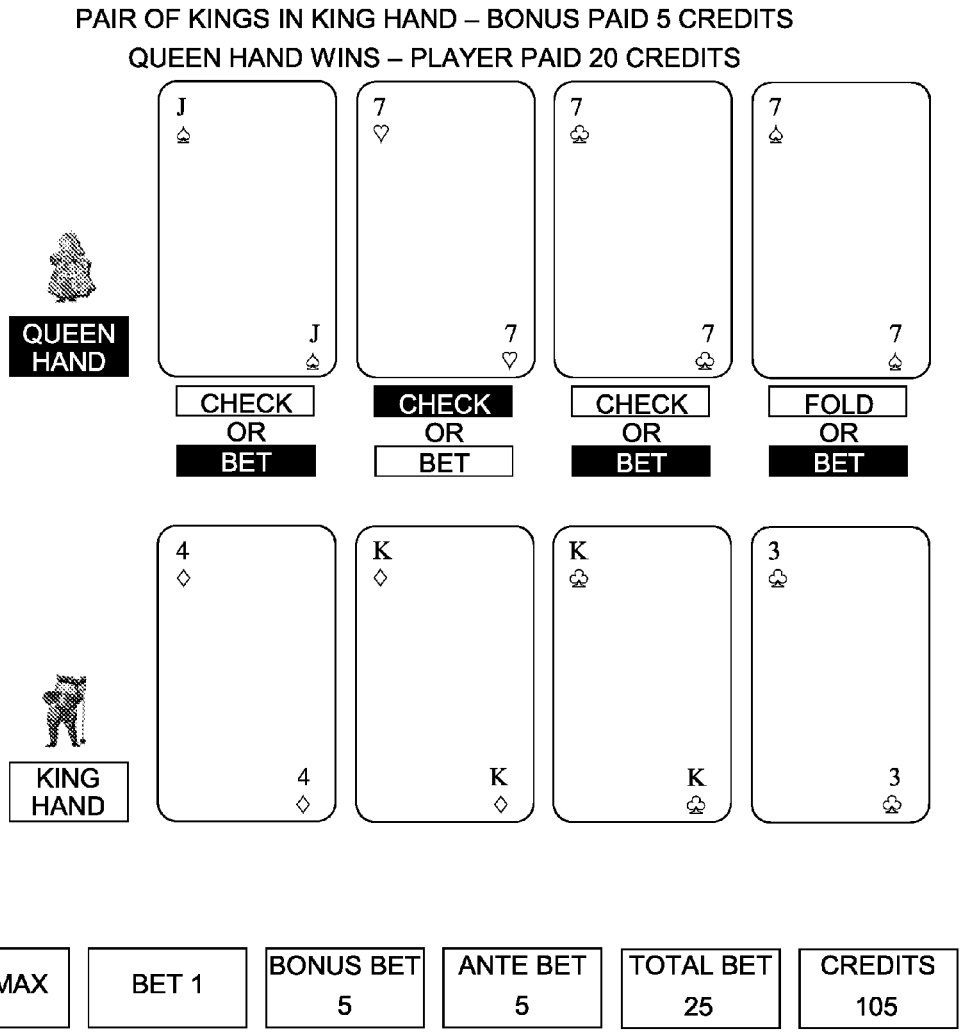
FIG. 5F is a front view of a screen shot of a game conducted according to an embodiment of the present invention.

In FIG. 5F, the remaining cards of the King hand are exposed and wagers are resolved. In this case, the three of a kind in the Queen hand outranks the pair in the King hands. The ante wager and three additional wagers received on the Queen hand are rewarded. Additionally, in this example, the bonus wagers are rewarded by examining both the King and Queen hands for bonus holdings according to a bonus pay table. In this example, a pair of Kings in the King hand may be a bonus hand (although this may vary in alternate optional embodiments), which results in a pay out for the bonus wager.

The same example game is illustrated in FIG. 6A-6F, but now based on receiving a designation of the King hand to resolve the ante wagers and additional wagers. In this case, the first cards revealed in FIG. 6B may cause a player who has wagered on the King hand to elect to check since the first card of the King hand is lower than the first card of the Queen hand.

Figure 6A:
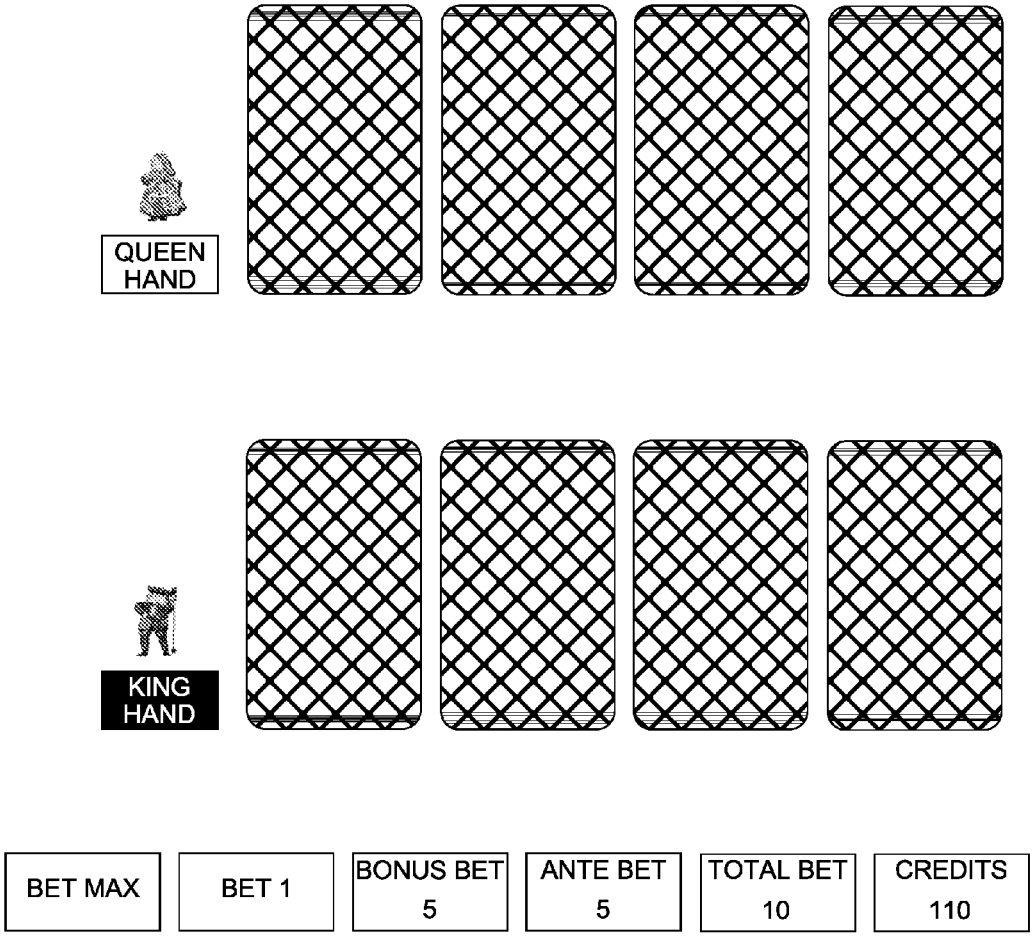
FIG. 6A is a front view of a screen shot of a game conducted according to an embodiment of the present invention.
Figure 6B:
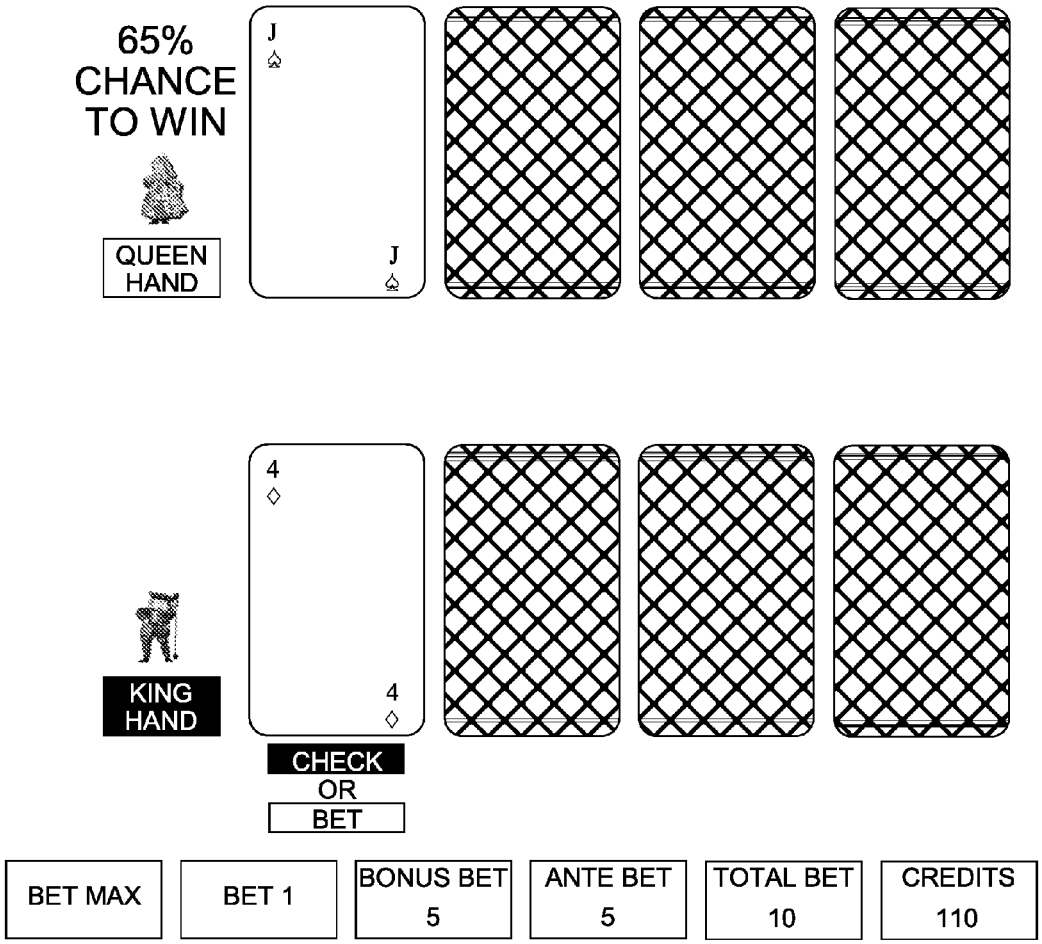
FIG. 6B is a front view of a screen shot of a game conducted according to an embodiment of the present invention.
Figure 6C:
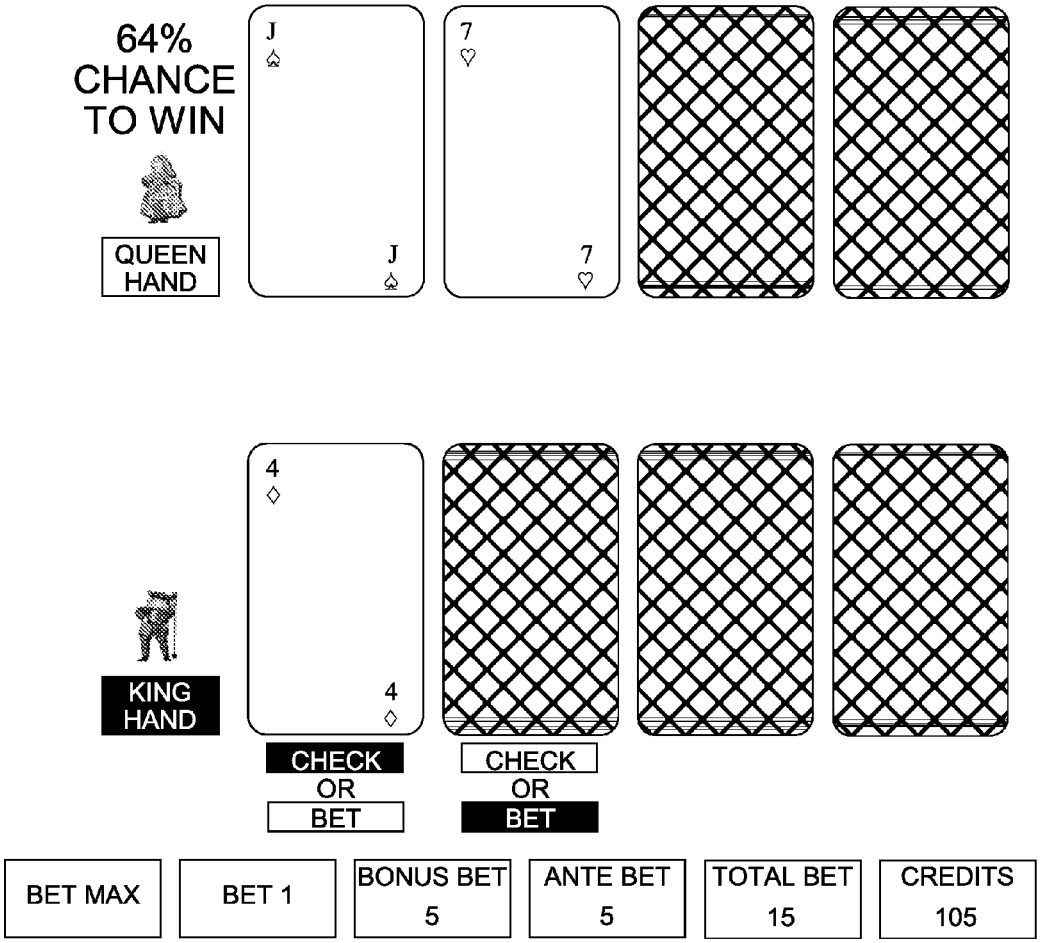
FIG. 6C is a front view of a screen shot of a game conducted according to an embodiment of the present invention.
Figure 6D:
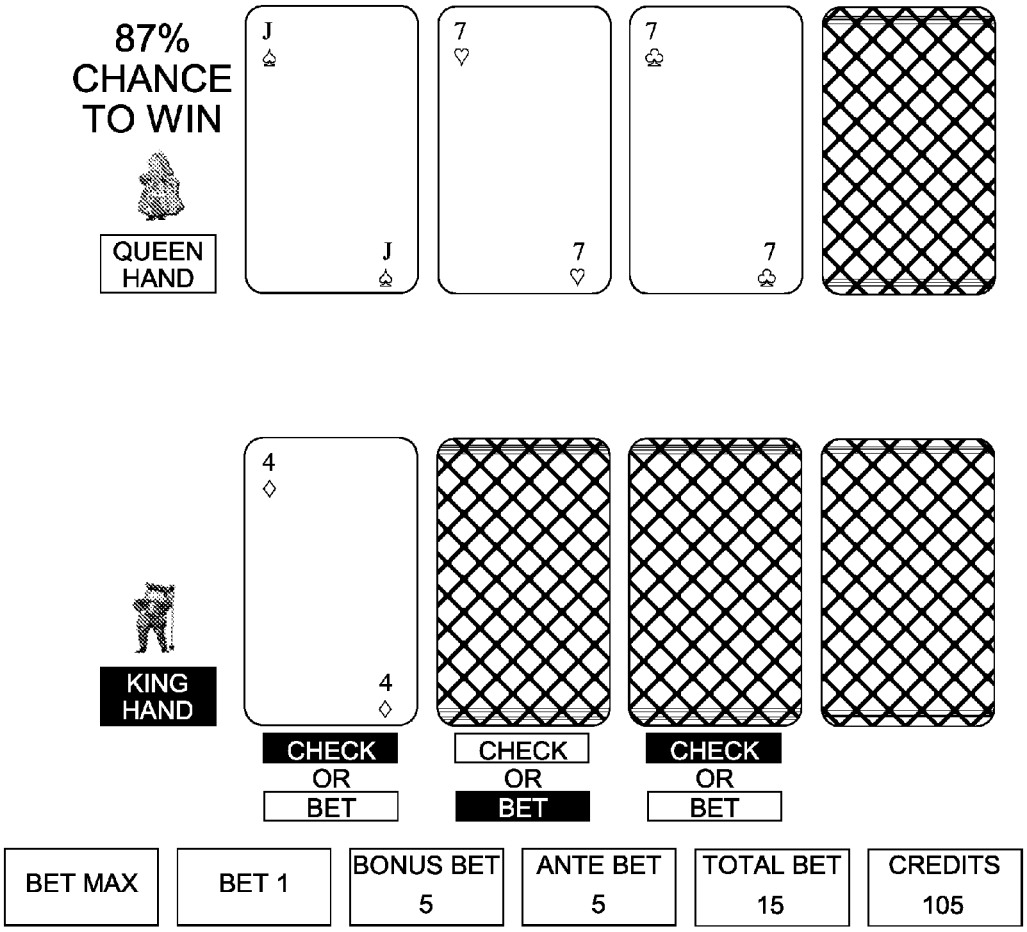
FIG. 6D is a front view of a screen shot of a game conducted according to an embodiment of the present invention.
Figure 6E:
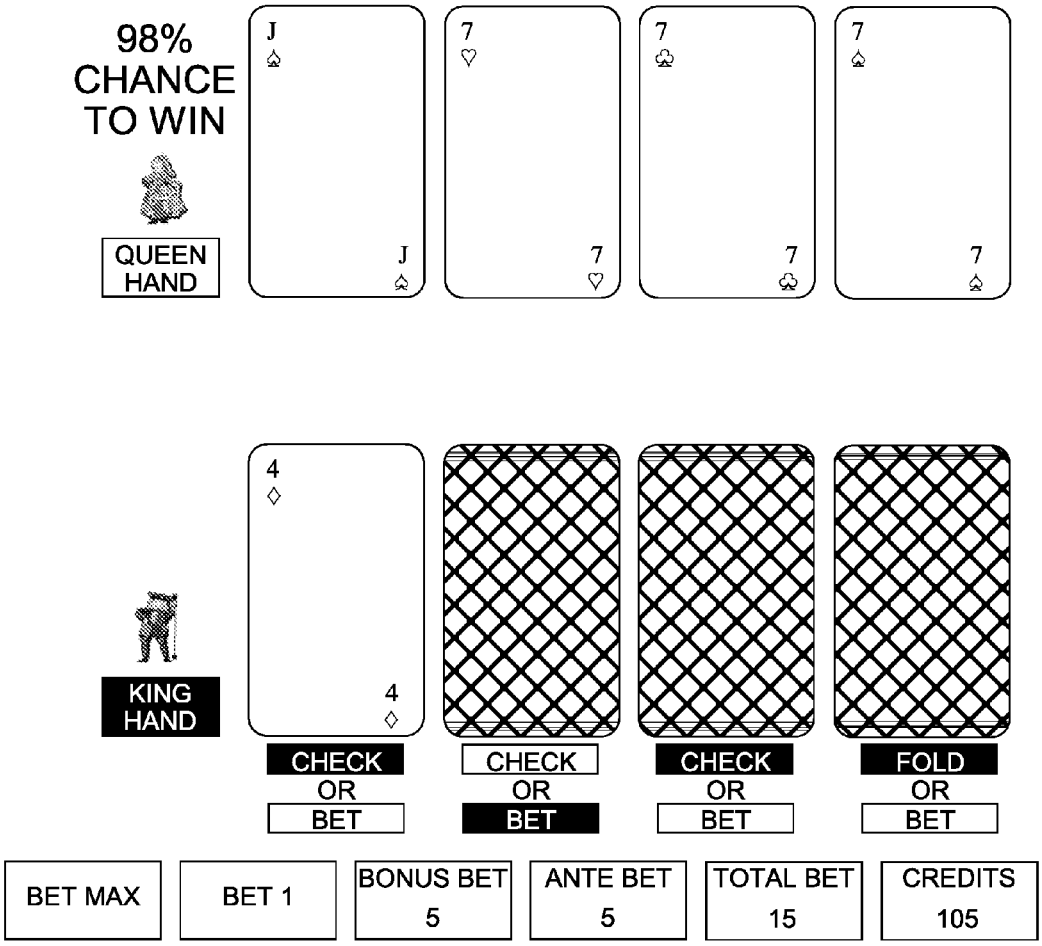
FIG. 6E is a front view of a screen shot of a game conducted according to an embodiment of the present invention.
Figure 6F:
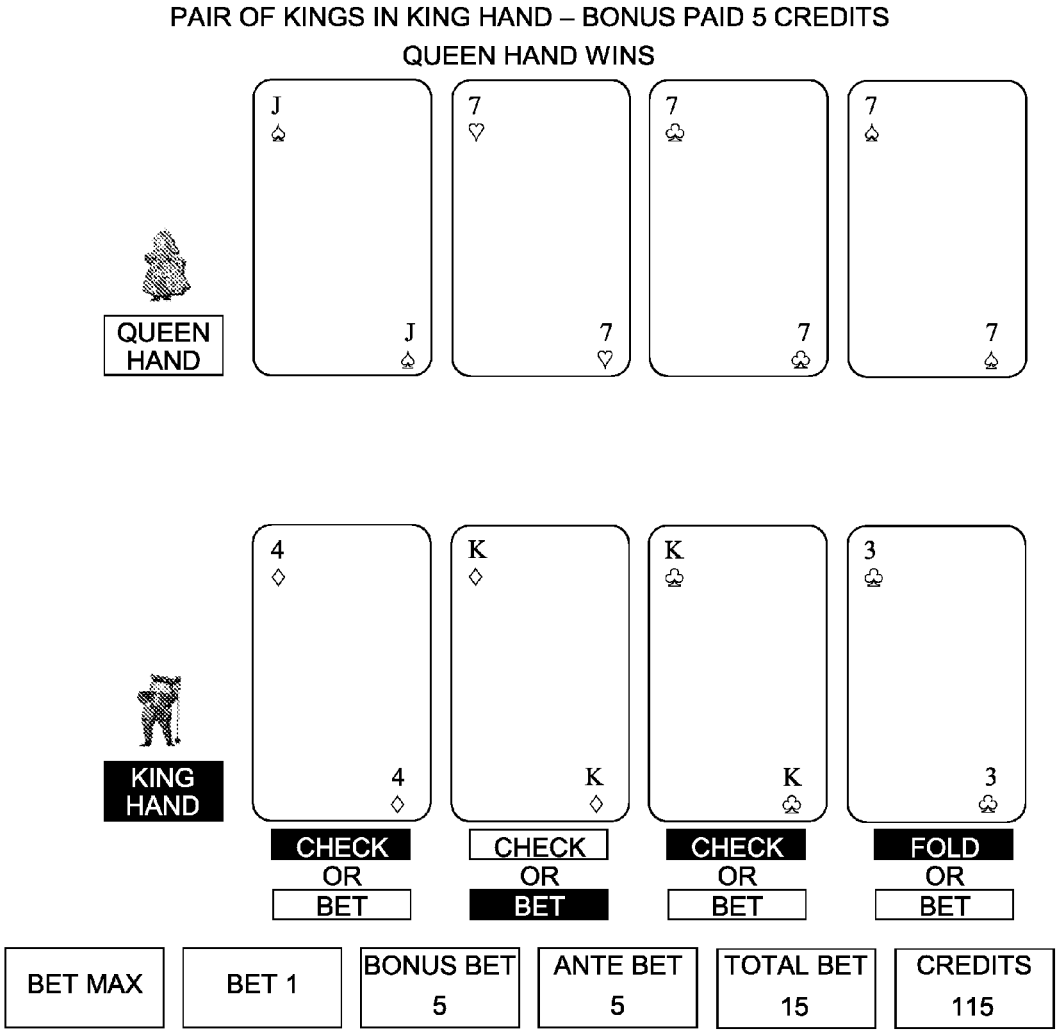
FIG. 6F is a front view of a screen shot of a game conducted according to an embodiment of the present invention.

Referring to FIG. 6C, an election may be received to bet when the second card of the Queen hand is exposed since the second card matches neither the suit nor the value of the first card in the Queen hand. In FIGS. 6D and 6E, however, it is apparent that the Queen hand has formed at least a pair, then ultimately a three of a kind. In this example, an election to fold is received in FIG. 6E after the Queen hand is shown to hold a three of a kind. That is, a player may elect to fold based on his or her expectation that the as-yet unexposed King hand will not contain a combination that outranks a three of a kind.

The examples illustrated in the figures are intended to be illustrative as the present method could be applied to other types of games. Moreover, while the examples illustrate an equal number of game pieces (e.g., playing cards) exposed in each stage, it is contemplated that at least one stage may include exposure of a different quantity of cards. For example, a first stage may include the exposure of two cards in a first game hand (such as the Queen hand) and one card in the King hand. This could lead to the first game hand (e.g., a Queen hand) exposed in three stages.

As applied to a game such as pai gow, a first game hand may be exposed in stages, with each stage interceded with an option to check or bet. The final stage may be followed by an option to bet or fold. A second game hand may then be exposed. In the course of exposing the first game hand, the likelihood of a game hand winning may be displayed on a display screen at a live table or an electronic device. After the first game hand is exposed, the first hand may be set into a front hand and a back hand as known in conventional pai gow by a house dealer. The second game hand may be exposed and set by the house dealer. With the aids of the percentage displays and the house dealer setting the pai gow hands, a player could participate in a pai gow-type game without necessarily knowing the optimum play for pai gow.

In an optional embodiment applied to blackjack, an ante wager and a bonus wager may be received and a dealer hand may be exposed in stages or at once, depending on the dealer draw rules and the initial hand dealt to the dealer. The player would then elect to bet or fold and would play his or her hand to completion. If the player's hand outranks the dealer's hand, the player would be rewarded on his or her ante wager and any additional wagers.

An optional embodiment directed to baccarat may be similar to a blackjack method, but using shared Player and Banker game hands. More particularly, an ante wager and a bonus wager may be received, along with a designation of either the Player game hand or Banker game hand. One of the game hands may be exposed in stages or at once, depending on the draw rules and the initial hand dealt. The player would then elect to bet or fold based on the exposed game hand. The other game hand would be exposed and wagers resolved.

As discussed above, the present method could be applied to many other types of conventional and "carnival" type games.

Figure 7:
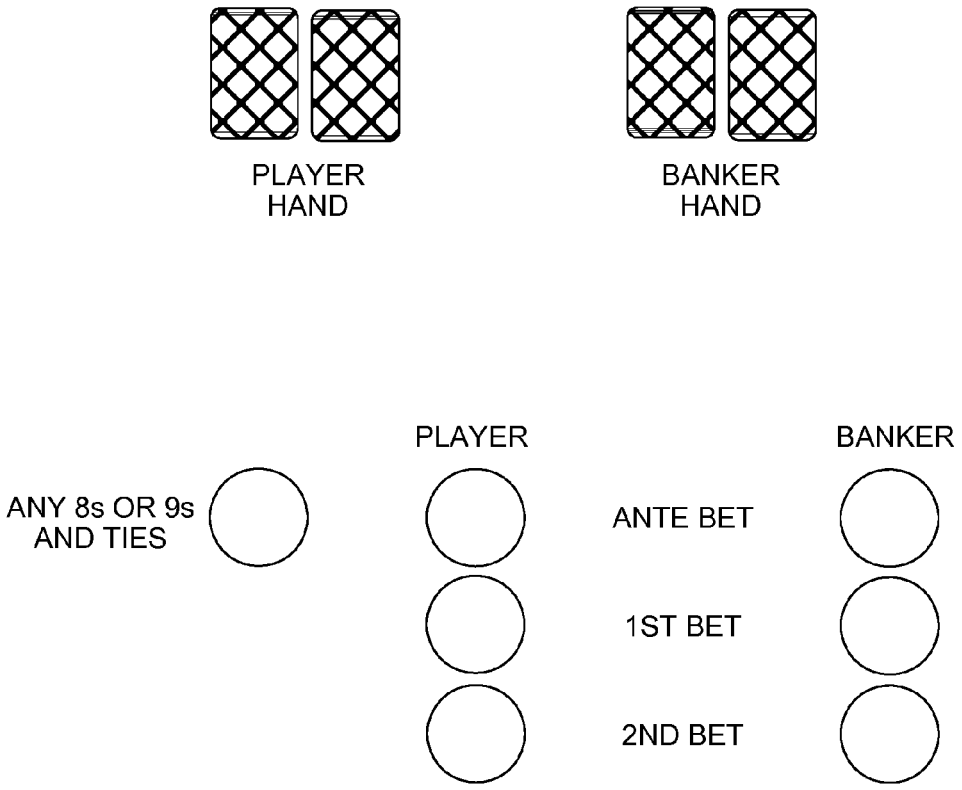
FIG. 7 is a top view of a layout for conducting a method according to an embodiment of the present invention.

For example, in one optional embodiment, illustrated in FIG. 7, a method may be applied to a baccarat-type game. In the optional embodiment illustrated in FIG. 7, the baccarat game is modified so that no draw occurs, i.e., the game is resolved based on the initial two cards dealt to each of a banker hand and a player hand.

In one such optional embodiment, a first wager, or ante wager, is received. The first wager is associated with either the banker hand or the player hand, i.e., the first wager is placed "on" either the banker hand or the player hand. In an optional embodiment, a mandatory side wager is also received. In a further optional embodiment, an election may be received to place an optional side wager. The side wagers are discussed in greater detail below.

After the first wager is received, a player hand and a banker hand are dealt. In this optional embodiment, the banker hand and player hand each contain two cards. The player hand and banker hand are partially exposed. In one example, one card of the player hand and one card of the banker hand are exposed. After partially exposing the player hand and banker hand, a second wager is received. The second wager may be correlated with either the player hand or banker hand. Specifically, the second wager is not required to be associated with the same hand as the first wager. Rather, the second wager may be placed on either the same hand or the opposite hand as the first wager. Thus, in one example, a first wager may designate the player hand for resolution of the first wager, while a second wager may designate the banker hand for resolution of the second wager.

After receiving second wagers and designations for second wagers, one of the hands is fully exposed. In one example, the second card of the player hand is exposed (although it is contemplated that the second card of the banker hand could alternatively be exposed). Based on the fully exposed hand and the partially exposed hand, a third wager is received. Again, the third wager may designate either the banker hand or the player hand for resolution of the third wager and is the hand used to resolve the third wager is not determined or dictated by the hand designated by the first wager or second wager. Thus, in one example, the first wager may designate the player hand, the second wager may designate the banker hand, and the third wager may designate the banker hand (if the player hand is felt to be weak or the banker hand is felt to be strong) or the player hand (if the player hand is felt to be strong or the banker hand is felt to be weak).

The as-yet unexposed hand is exposed and the player hand and banker hand are compared. In an optional embodiment, the player hand and banker hand are compared using conventional baccarat comparisons. That is, a hand value is calculated for each of the player hand and banker hand by summing the values, modulo ten, of the cards within the hand. In summing the values, every card is associated with its face value, with tens, jacks, queens, and kings having a value of zero, and aces having a value of one. Thus, a hand which contains a seven and an eight has a sum of fifteen, and a sum, modulo ten, of five. Similarly, a hand which contains a nine and a jack has a sum, modulo ten, of nine. In such an optional embodiment, the hand with the highest sum (or sum closest to a target value of nine) is the winning hand. In the example, a hand with a sum, modulo ten, of nine outranks a hand with a sum, modulo ten, of five. In an optional embodiment, wagers on the winning hand are paid, optionally at even money, and wagers on the losing hand are collected. In an optional embodiment, all wagers are collected in the event of a tie. In alternate optional embodiments, ties may result in return of some, or all, the wagers.

In an optional embodiment, side wagers may be offered. In one such optional embodiment, a mandatory side wager may be received. When a natural sum (a sum, modulo ten, of eight or nine) occurs in either hand, a payout is issued based on the mandatory side wager. Additionally, when a tie occurs, a payout is issued based on the mandatory side wager.

In another optional embodiment, an optional side wager may be received. When the two hands include matching cards, a payout may be issued based on the quantity of matching cards. For example, in a game in which the player hand and banker hand each include two cards, payouts may be issued for 1 pair, 2 pair, 3 of a kind, or 4 of a kind.

Figure 8:
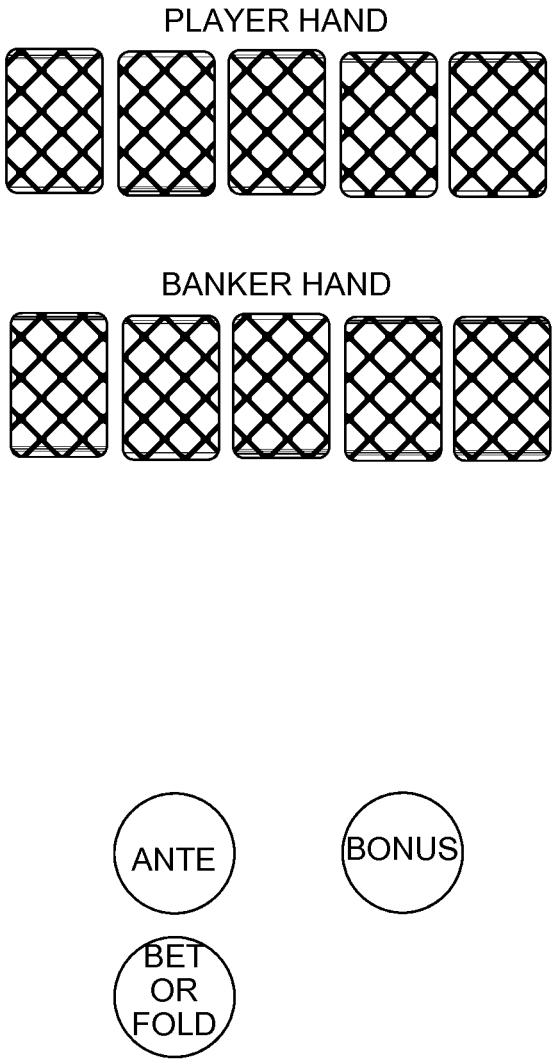
FIG. 8 is a top view of a layout for conducting a method according to an embodiment of the present invention.

In another example illustrated in FIG. 8, the present invention may be applied to a poker-type game which may include hands containing any quantity of playing cards, e.g. three-card hands, four-card hands, five-card hands, or the like. In the example of FIG. 8, an ante wager is received and two hands are dealt. A first poker hand is dealt fully exposed while a second poker hand is dealt unexposed. A data processor obtains the content of the first poker hand, such as through an optical reader in a shuffler, card shoe, or table surface or through a manually-operated input device. The data processor then calculates the relative strength of the first poker hand, e.g., the odds that the first poker hand will win against any other hand that could be formed from the cards remaining in the deck. In an optional embodiment, the odds are displayed at a display. Additionally, the relative strength of the first poker hand is used by the data processor to dynamically determine and display a payout associated with a bet placed on the unexposed second poker hand against the exposed first poker hand. In an optional embodiment, the payout varies with the relative strength of the first poker hand. Thus, in one optional embodiment, a game in which the first poker hand contains a three of a kind will result in a different display (and a different displayed payout) than a game in which the first poker hand contains king-high. As may be appreciated, the odds that the first poker hand would win against any other hand that can be formed from the remaining cards is higher with the three of a kind than with king-high and, thus, the payout if the second poker hand outranks the first poker hand would be greater when the first poker hand contains a three of a kind than if the first poker hand contains king-high.

In an optional embodiment, a bet or fold step occurs in which an election is received to place an additional wager or terminate play. If the bet is elected, an additional wager is received. Again, the payout for the bet, if the bet is elected, is dynamically determined based on the evaluation of the first poker hand. If a fold is elected, play is terminated and the ante wager is collected.

In additional or alternate optional embodiments, additional bet or check (or bet or fold) steps may be conducted in which cards from the second poker hand are exposed and an election is received to bet or check (or bet or fold). In one such optional embodiment, the odds of the first poker hand winning and the payout for the bet placed at that stage may be recalculated and displayed at each stage.

After all betting stages are complete, the second poker hand is fully exposed and compared to the first poker hand. Ante wagers and additional wagers are paid if the second poker hand outranks the first poker using the payout displayed when the bet was placed. Ante wagers and additional wagers are collected if the first poker hand outranks the second poker hand. Ties may be handled in any manner.

In an optional embodiment, side wagers may be received on the hand ranking of the first poker hand and second poker hand. In an optional embodiment, a side wager pay table may be defined with bonus poker hands and associated payouts. A side wager is received at the commencement of the game. After the first poker hand and second poker hand are exposed, the first poker hand and second poker hand are compared to the side wager pay table. The side wager is rewarded with the associated pay out if either of the first poker hand or the second poker hand contains a bonus poker hand. In an optional embodiment, only the highest payout is paid if both the first poker hand and second poker hand contain bonus poker hands. In another optional embodiment, proposition wagers may be offered in which the first poker hand is exposed in stages and proposition wagers may be received after each stage. If the card exposed immediately prior to the placement of a proposition wager is the card that creates the final hand ranking for the first poker hand, the proposition wager is rewarded. For example in an embodiment applied to three-card poker hands, if the first poker hand is exposed in stages and the first stage exposes a King, the second stage exposes a King, the third stage exposes a ten, proposition wagers placed after the second stage would be rewarded, while proposition wagers placed at any other stages would be collected.

While certain embodiments of the present invention have been shown and described it is to be understood that the present invention is subject to many modifications and changes without departing from the spirit and scope of the claims presented herein.

What is claimed is:

1. A method for conducting a wagering game at an electronic gaming machine using a set of game pieces to form at least a first game hand and a second game hand, said gaming machine comprising a data processor, at least one input device in communication with said data processor, at least one electronic video display in communication with said data processor, at least one wager accepting device configured to receive a physical item representing a monetary value; and a data storage device in communication with said data processor, the data storage device storing program instructions executable by said data processor, the method comprising:

a) receiving from the player via said input device an ante wager;

b) dealing by said data processor said first game hand from said game pieces and displaying via said at least one electronic video display said first game hand with at least one, but not all, game pieces in said first game hand exposed;

c) receiving an election from the player via said input device to place a bet wager based on the at least one exposed game piece in the first game hand;

d) after receiving said at least one first election from the player, displaying via said at least one electronic video display said first game hand with one or more additional game pieces in the first game hand exposed;

e) repeating steps c) and d) until all game pieces in the first game hand are exposed;

f) receiving an election from the player via said input device to place a play wager based on the first game hand with all game pieces exposed;

g) dealing by said data processor said second game hand and displaying via said at least one electronic video display said second game hand with all game pieces of the second game hand exposed; and h) resolving said ante wager, each bet wager and said play wager with reference to said first and second game hands.

2. The method in accordance with claim 1 wherein said ante wager is a push if said first game hand does not have a qualifying rank.

3. The method in accordance with claim 1 wherein each bet wager is resolved in favor of said player if said second game hand does not outrank said first game hand.

4. The method in accordance with claim 1 wherein said player loses each bet wager if said second game hand does not outrank said first game hand.

5. The method in accordance with claim 1 wherein said player loses said ante wager, each bet wager and said play wager if said player does not elect to place each bet wager and said play wager.

6. The method in accordance with claim 1 further comprising the step of receiving a bonus wager from said player.

7. The method in accordance with claim 6 further comprising resolving said bonus wager in favor of said player if either said first game hand or said second game hand have a minimum qualifying rank.

8. The method in accordance claim 1, wherein said game pieces are playing cards.

9. The method in accordance with claim 1, comprising receiving a first election from said player to place a first bet wager and revealing one or more additional game pieces in said first game hand and receiving a second election from said player to place a second bet wager and revealing the remaining game pieces in said first game hand.

* * * * *